US011404833B2

(12) United States Patent
Urtz, Jr. et al.

(10) Patent No.: US 11,404,833 B2
(45) Date of Patent: Aug. 2, 2022

(54) ENHANCED ELECTRICAL GROUNDING OF HYBRID FEEDTHROUGH CONNECTORS

(71) Applicant: John Mezzalingua Associates, LLC, Liverpool, NY (US)

(72) Inventors: Thomas Sawyer Urtz, Jr., North Syracuse, NY (US); Colter P. Mahlum, Liverpool, NY (US); Brandon M. Stevens, Liverpool, NY (US)

(73) Assignee: JOHN MEZZALINGUA ASSOCIATES, LLC, Liverpool, NY (US)

( * ) Notice: Subject to any disclaimer, the term of this patent is extended or adjusted under 35 U.S.C. 154(b) by 0 days.

(21) Appl. No.: 16/972,934

(22) PCT Filed: Jun. 27, 2019

(86) PCT No.: PCT/US2019/039446

§ 371 (c)(1),
(2) Date: Dec. 7, 2020

(87) PCT Pub. No.: WO2020/006195

PCT Pub. Date: Jan. 2, 2020

(65) Prior Publication Data

US 2021/0249829 A1 Aug. 12, 2021

Related U.S. Application Data

(60) Provisional application No. 62/691,852, filed on Jun. 29, 2018.

(51) Int. Cl.
*H01R 24/56* (2011.01)
*H01R 13/6591* (2011.01)
(Continued)

(52) U.S. Cl.
CPC ..... *H01R 24/564* (2013.01); *H01R 13/15* (2013.01); *H01R 13/622* (2013.01); *H01R 13/65912* (2020.08); *H01R 2103/00* (2013.01)

(58) Field of Classification Search
CPC ..... H01R 24/564; H01R 13/65912; H01R 13/15; H01R 13/622; H01R 2103/00
See application file for complete search history.

(56) References Cited

U.S. PATENT DOCUMENTS 7,455,550 B1 11/2008 Sykes
7,753,727 B1 * 7/2010 Islam ..... H01R 24/40 439/583

(Continued)

OTHER PUBLICATIONS

International Searching Authority, International Search Report and Written Opinion, dated Oct. 18, 2019, 11 pages.

(Continued)

*Primary Examiner* — Oscar C Jimenez
*Assistant Examiner* — Paul D Baillargeon
(74) *Attorney, Agent, or Firm* — Barclay Damon LLP

(57) ABSTRACT

An RF Connector and grounding device therefor comprises a driver, a contact ring and a spring clamp having a split ring washer disposed therebetween. The split ring washer interposes the driver on one side of the washer and the contact ring on the other side thereof and defines an aperture for receiving a prepared end of a coaxial cable. The washer is connected to one side of an annular ring while a shouldered flange is disposed on the opposing side of the ring. Upon delivering a compressive clamping force to a compression cap, the split ring washer is captured between adjacent peaks or corrugations of the outer conductor.

18 Claims, 21 Drawing Sheets

(51) Int. Cl.

| | |
|---|---|
| ***H01R 13/15*** | (2006.01) |
| ***H01R 13/622*** | (2006.01) |
| ***H01R 103/00*** | (2006.01) |

(56) References Cited

U.S. PATENT DOCUMENTS

| | | | | |
|---|---|---|---|---|
| 8,430,688 | B2 * | 4/2013 | Montena | H01R 24/564 439/578 |
| 9,633,765 | B2 * | 4/2017 | Natoli | H01B 11/18 |
| 2010/0261381 | A1 | 10/2010 | Montena et al. | |
| 2014/0342594 | A1 | 11/2014 | Montena | |
| 2016/0336676 | A1 | 11/2016 | Stevens et al. | |
| 2018/0006420 | A1 | 1/2018 | Urtz, Jr. | |

OTHER PUBLICATIONS

International Preliminary Report on Patentability, International Preliminary Examining Authority, dated Jan. 6, 2021, 6 pages.

European Patent Office, Extended European Search Report, Application No. 19825730.5, Patent No. 3815196, dated Feb. 21, 2022, pp. 10.

* cited by examiner

ENHANCED ELECTRICAL GROUNDING OF HYBRID FEEDTHROUGH CONNECTORS

RELATED APPLICATIONS

This application claims the benefit of, and priority to, provisional patent application Ser. No. 62/691,852 entitled "Enhanced Electrical Grounding Of Hybrid Feed-Through Connectors, filed on Jun. 29, 2018. Furthermore, the application relates to Non-Provisional patent application entitled "Hybrid Feed Through Connectors for Coaxial Cables," Ser. No. 15/624,225, filed on Jun. 15, 2017. The complete specification of these applications are hereby incorporated by reference in their entirety.

TECHNICAL FIELD

The present disclosure relates to RF connectors for wiring harnesses such as telecommunication jumper cables, and more particularly, to a grounding device therefor providing improved electrical grounding while facilitating assembly and manufacture.

BACKGROUND

Coaxial cable is a typical transmission medium used in communications networks, such as in the infrastructure of a cellular communications network. Recently, "superflex" cables have been introduced which employs an outer conductor having coils which articulate in any direction. That is, the coils slide over, or relative to, one another to allow the cable to negotiate relatively tight turns or radii as the cable connects to ports/junction boxes from pole to pole. While making this connection, it is critical that the transmission cable be securely interconnected to the port/junction box without disrupting the ground connection of the cable. This requires a skilled technician to make the interconnection.

Currently, machined spiral clamps are employed over the exterior of the superflex conductor to produce a highly conductive mating interface. While the interface facilitates the transfer of electric current to enhance grounding protection, the thread profile requires that tight machining tolerances must be held during manufacture. As such, machining costs can be prohibitively expensive, especially when dealing with variations in cable/conductor size from one manufacturer to another.

Therefore, there is a need to overcome, or otherwise lessen the effects of, the disadvantages and shortcomings described above.

SUMMARY

Additional features and advantages of the present disclosure are described in, and will be apparent from, the following Brief Description of the Drawings and Detailed Description.

In one embodiment of the disclosure, an RF connector is provided for electrically engaging a coaxial cable having a prepared end comprising corrugated outer and center pin conductors for exchanging RF signals. The RF connector comprises: a connector body defining a bore for receiving the prepared end of the coaxial cable; a coupler defining a bore for receiving a forward end of the connector body; a compression cap defining a bore for receiving the prepared end of the coaxial cable and the aft end of the connector body; and a grounding device defining a driver, a contact ring and a spring clamp disposed therebetween. The driver of the grounding device includes a bore for (i) receiving the prepared end of the coaxial cable and (ii) engaging the aft end of the compression cap. The contact ring defines an aperture for receiving the prepared end of the coaxial cable and is disposed between the coaxial cable and a conductive inner surface of the connector body. The spring clamp defines a split ring washer configured to rotationally engage the corrugated surface of the outer conductor; wherein upon delivering a compressive clamping force to the compression cap, the spiral corrugations of the outer conductor compressively capture the split ring washer therebetween to electrically connect the outer conductor to the connector body.

In another embodiment, a grounding device is provided for an RF connector comprising a driver, a contact ring and a spring clamp having a split ring washer disposed therebetween. The split ring washer interposes the driver on one side of the washer and the contact ring on the other side thereof and defines an aperture for receiving a prepared end of a coaxial cable. The washer is connected to one side of an annular ring while a shouldered flange is disposed on the opposing side of the ring. Upon delivering a compressive clamping force to a compression cap, the split ring washer is captured between adjacent peaks or corrugations of the outer conductor.

BRIEF DESCRIPTION OF THE DRAWINGS

Additional features and advantages of the present disclosure are described in, and will be apparent from, the following Brief Description of the Drawings and Detailed Description.

FIGS. 17 and 18 depict the connector coupling the prepared end of the coaxial cable to the interface port wherein FIG. 17 depicts shows the outer conductor immediately prior to being drawn into and against the port body and wherein FIG. 18 depicts the connector fully engaged, i.e., axially displaced against the port body, such that the outer conductor is compressed between an inner annular ring of the port body and the compression or abutment surface of the sleeve.

DETAILED DESCRIPTION

Figure 1B:
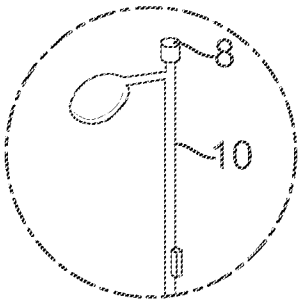
FIG. 1B illustrates a close-up view of an embodiment of a micro antenna of the outdoor wireless network mounted to a street lamp.
Figure 1A:
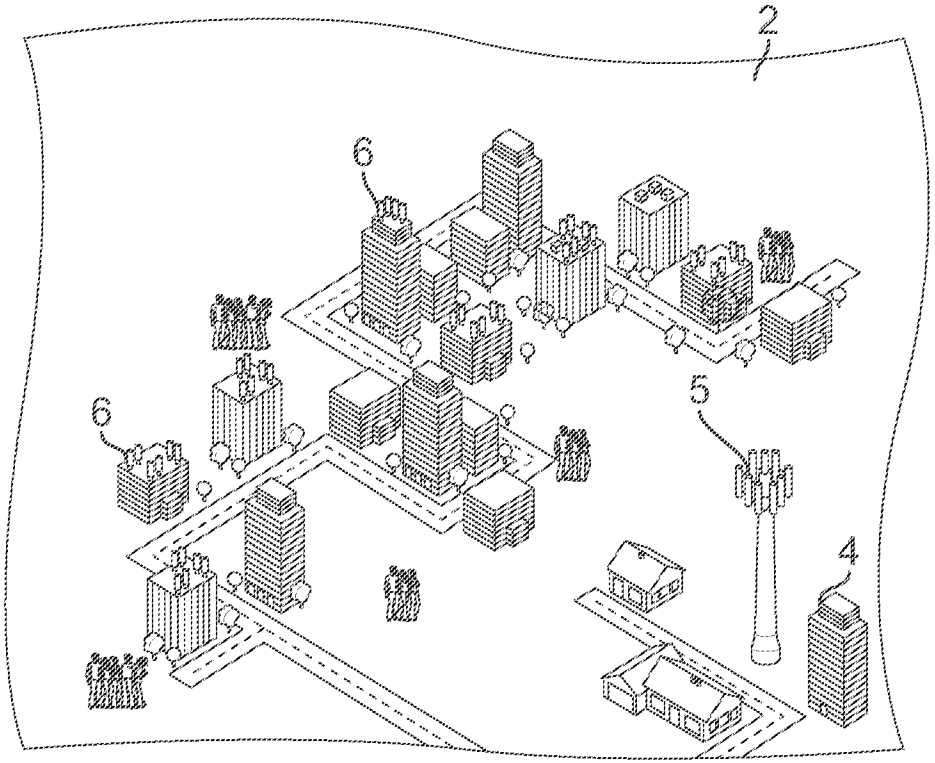
FIG. 1A is a schematic diagram illustrating an example of one embodiment of an outdoor wireless communication network.
Figure 2:
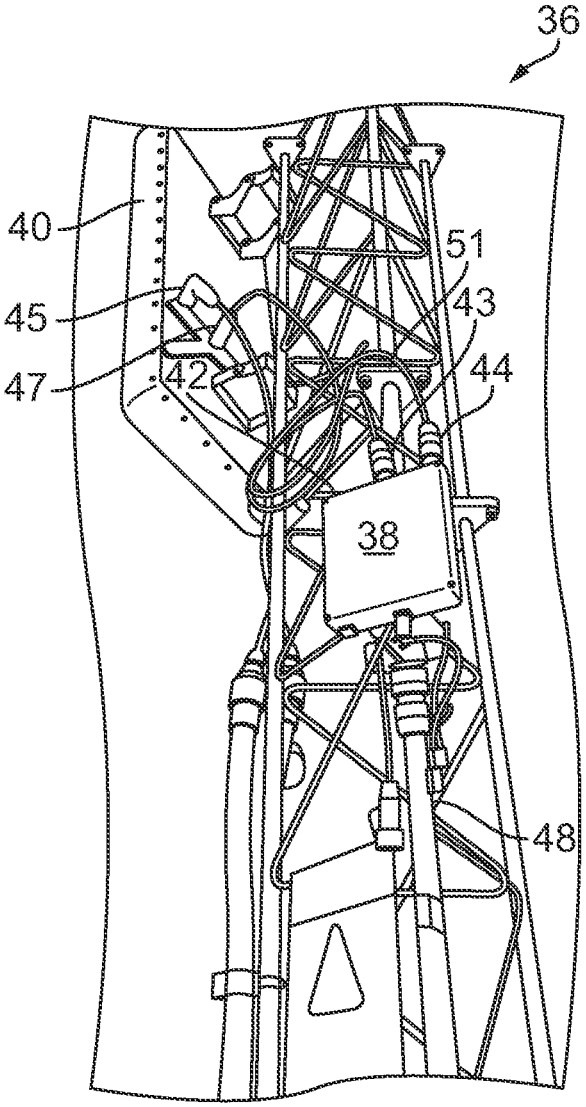
FIG. 2 is an isometric view of one embodiment of a tower.

Referring to FIGS. 1A and 1B, an outdoor wireless communication network 2 includes a cell site or cellular base station 4. The base station 4, in conjunction with cellular tower 5, serves communication devices, such as mobile phones, in a defined area surrounding the base station 4. The cellular tower 5 also operates in conjunction with macro antennas 6 on the tops of buildings as well as micro antennas 8 mounted to, for example, street lamps 10. In the example illustrated in FIG. 2, a tower 36 supports a radio head 38 and macro antenna 40. The radio head 38 has interface ports 42, 43 and 44 and the macro antenna 40 has antenna ports 45 and 47. In the example shown, the coaxial cable 48 is connected to the radio head interface port 42, while the coaxial cable jumpers 50 and 51 are connected to radio head interface ports 44 and 45, respectively. The coaxial cable jumpers 50 and 51 are also connected to antenna interface ports 45 and 47, respectively.

The interface ports of the network 2 can have different shapes, sizes and surface types depending upon the embodiment. In one embodiment illustrated in FIG. 3, the interface port 52 has a tubular or cylindrical shape. The interface port 52 includes: (a) a forward end or base 54 configured to abut the network device enclosure, housing or wall 56 of a network device; (b) a coupler engager 58 configured to be engaged with a cable connector's coupler, such as a nut; (c) an electrical ground 60 received by the coupler engager 58; and (d) a signal carrier 62 received by the electrical grounder 60.

Figure 4:
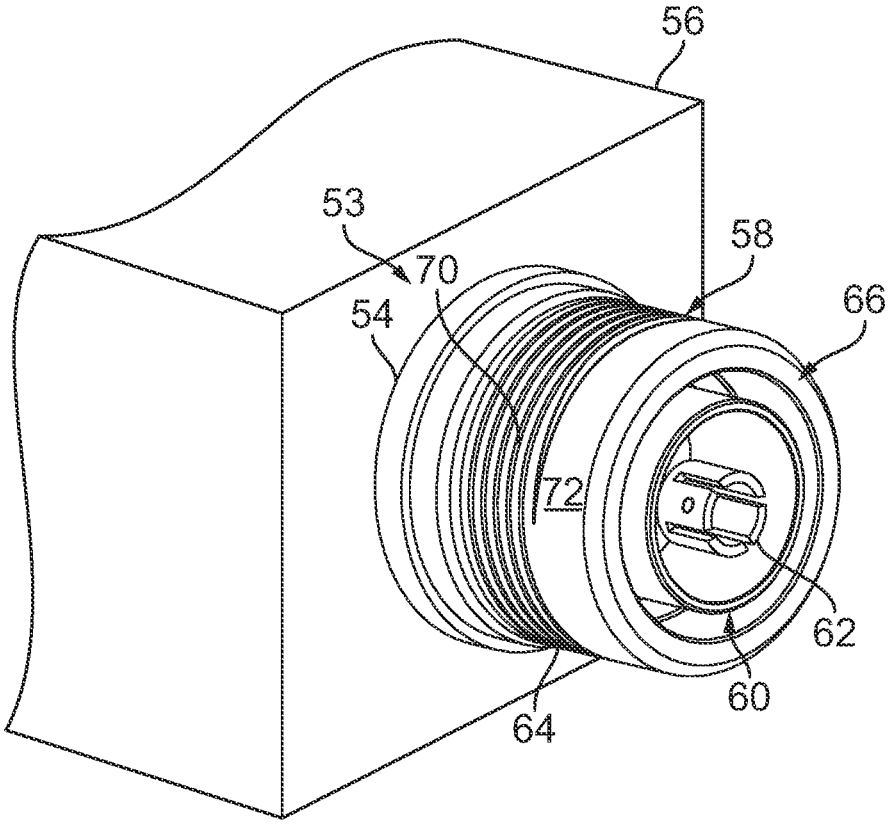
FIG. 4 is an isometric view of another embodiment of an interface port.
Figure 5:
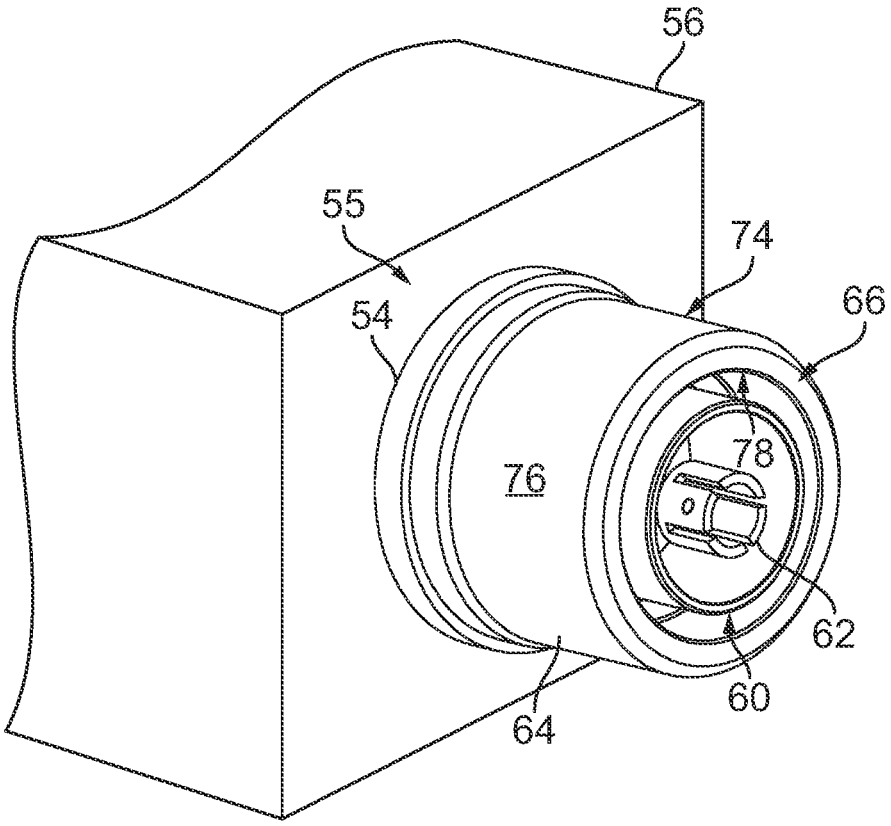
FIG. 5 is an isometric view of yet another embodiment of an interface port.

In the illustrated embodiment, the base 54 has a collar shape with a diameter larger than the diameter of the coupler engager 58. The coupler engager 58 is tubular in shape, has a threaded, outer surface 64 and a rearward end 66. The threaded outer surface 64 is configured to threadably mate with the threads of the coupler of a cable connector, such as connector 68 described below. In one embodiment illustrated in FIG. 4, the interface port 53 has a forward section 70 and a rearward section 72 of the coupler engager 58. The forward section 70 is threaded, and the rearward section 72 is non-threaded. In another embodiment illustrated in FIG. 5, the interface port 55 has a coupler engager 74. In this embodiment, the coupler engager 74 is the same as coupler engager 58 except that it has a non-threaded, outer surface 76 and a threaded, inner surface 78. The threaded, inner surface 78 is configured to be inserted into, and threadably engaged with, a cable connector.

Referring to FIGS. 7-10, in one embodiment, the signal carrier 62 is tubular and configured to receive a pin or inner conductor engager 80 of the cable connector 68. Depending upon the embodiment, the signal carrier 62 can have a plurality of fingers 82 which are spaced apart from each other about the perimeter of the signal carrier 80. When the cable inner conductor 84 is inserted into the signal carrier 80, the fingers 82 apply a radial, inward force to the inner conductor 84 to establish a physical and electrical connection with the inner conductor 84. The electrical connection enables data signals to be exchanged between the devices that are in communication with the interface port. In one embodiment, the electrical ground 60 is tubular and configured to mate with a connector ground 86 of the cable connector 68. The connector ground 86 extends an electrical ground path to the ground 64 as described below.

Cables

In one embodiment illustrated in FIGS. 2 and 6-8, the network 2 includes one or more types of coaxial cables 88. In the embodiment illustrated in FIG. 6, the coaxial cable 88 has: (a) a conductive, central wire, tube, strand or inner conductor 84 that extends along a longitudinal axis 92 in a forward direction F toward the interface port 56; (b) a cylindrical or tubular dielectric, or insulator 96 that receives and surrounds the inner conductor 84; (c) a conductive tube or outer conductor 98 that receives and surrounds the insulator 96; and (d) a sheath, sleeve or jacket 100 that receives and surrounds the outer conductor 98. In the illustrated embodiment, the outer conductor 98 is corrugated, having a spiral, exterior surface 102. The exterior surface 102 defines a plurality of peaks and valleys to facilitate flexing or bending of the cable 88 relative to the longitudinal axis 92.

Figure 6:
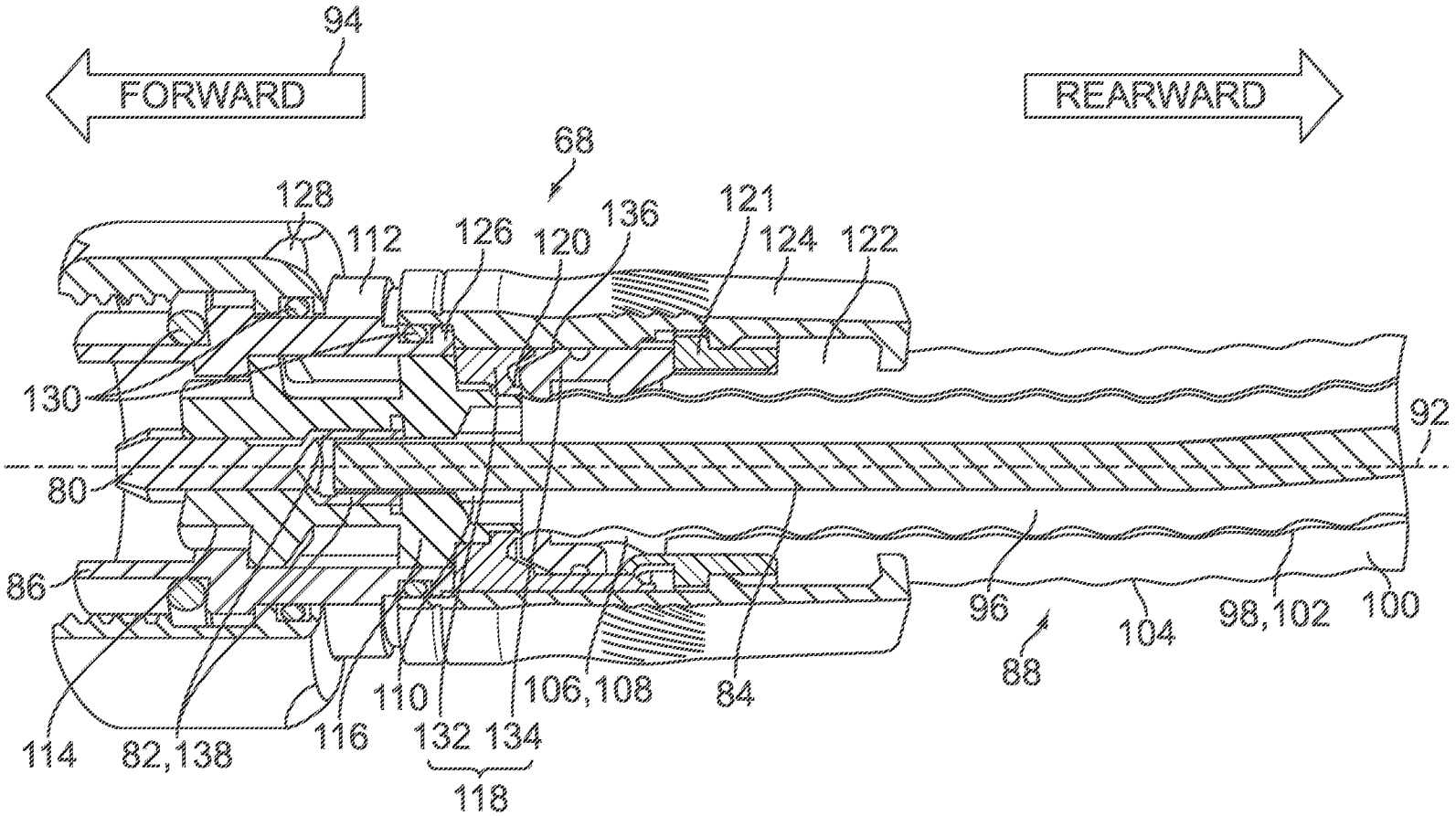
FIG. 6 is an isometric, cut-away view of one embodiment of a cable connector and cable.

To achieve the cable configuration shown in FIG. 6, an assembler/preparer, in one embodiment, takes one or more steps to prepare the cable 88 for attachment to the cable connector 68. In one example, the steps include: (a) removing a longitudinal section of the jacket 104 to expose the bare surface 106 of the outer conductor 108; (b) removing a longitudinal section of the outer conductor 108 and insulator 96 so that a protruding end 110 of the inner conductor 84 extends forward, beyond the recessed outer conductor 108 and the insulator 96, forming a step-shape at the end of the cable 68; (c) removing or coring-out a section of the recessed insulator 96 so that the forward-most end of the outer conductor 108 protrudes forward of the insulator 96.

In another embodiment not shown, the cables of the networks 2 include one or more types of fiber optic cables. Each fiber optic cable includes a group of elongated light signal guides or flexible tubes. Each tube is configured to distribute a light-based or optical data signal to the networks 2 and 12.

Connectors

In the embodiment illustrated in FIG. 6, the cable connector 68 includes: (a) a connector housing or connector body 112; (b) a connector insulator 114 received by, and housed within, the connector body 112; (c) the inner conductor engager 80 received by, and slidably positioned within, the connector insulator 114; (d) a driver 116 configured to axially drive the inner conductor engager 80 into the connector insulator 114 as described below; (e) an outer conductor clamp device or outer conductor clamp assembly 118 configured to clamp, sandwich, and lock onto the end section 120 of the outer conductor 106; (f) a clamp driver 121; (g) a tubular-shaped, deformable, environmental seal 122 that receives the jacket 104; (h) a compressor 124 that receives the seal 122, clamp driver 121, clamp assembly 118, and the rearward end 126 of the connector body 112; (i) a nut, fastener or coupler 128 that receives, and rotates relative to, the connector body 112; and (j) a plurality of O-rings or ring-shaped environmental seals 130. The environmental seals 122 and 130 are configured to deform under pressure so as to fill cavities to block the ingress of environmental elements, such as rain, snow, ice, salt, dust, debris and air pressure, into the connector 68.

In one embodiment, the clamp assembly 118 includes: (a) a supportive outer conductor engager 132 configured to be inserted into part of the outer conductor 106; and (b) a compressive outer conductor engager 134 configured to mate with the supportive outer conductor engager 132. During attachment of the connector 68 to the cable 88, the cable 88 is inserted into the central cavity of the connector 68. Next, a technician uses a hand-operated, or power, tool to hold the connector body 112 in place while axially pushing the compressor 124 in a forward direction F. For the purposes of establishing a frame of reference, the forward direction F is toward interface port 55 and the rearward direction R is away from the interface port 55.

The compressor 124 has an inner, tapered surface 136 defining a ramp and interlocks with the clamp driver 121. As the compressor 124 moves forward, the clamp driver 121 is urged forward which, in turn, pushes the compressive outer conductor engager 134 toward the supportive outer conductor engager 132. The engagers 132 and 134 sandwich the outer conductor end 120 positioned between the engagers 132 and 134. Also, as the compressor 124 moves forward, the tapered surface or ramp 136 applies an inward radial force that compresses the engagers 132 and 134, establishing a lock onto the outer conductor end 120. Furthermore, the compressor 124 urges the driver 121 forward which, in turn, pushes the inner conductor engager 80 into the connector insulator 114.

The connector insulator 114 has an inner tapered surface with a diameter less than the outer diameter of the mouth or grasp 138 of the inner conductor engager 80. When the driver 116 pushes the grasp 138 into the insulator 114, the diameter of the grasp 138 is decreased to apply a radial inward force on the inner conductor 84 of the cable 88. As a consequence, a bite or lock is produced on the inner conductor 84.

Figure 3:
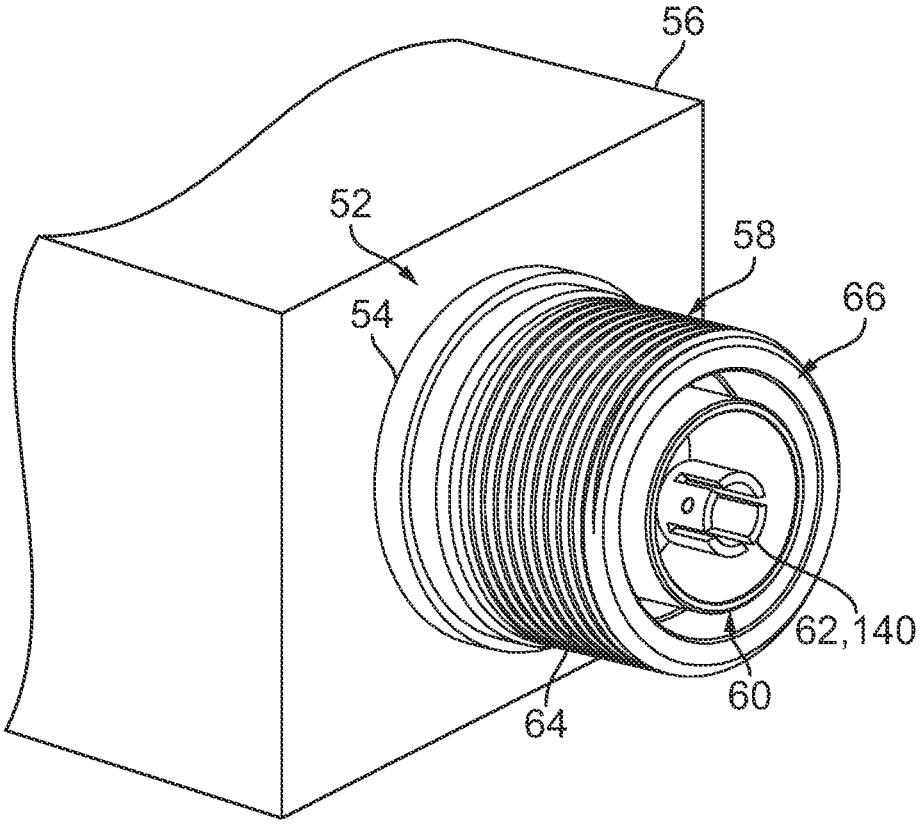
FIG. 3 is an isometric view of one embodiment of an interface port.

After the cable connector 68 is attached to the cable 88, a technician or user can install the connector 68 onto an interface port, such as the interface port 52 illustrated in FIG. 3. In one example, the user screws the coupler 128 onto the port 52 until the fingers 140 of the signal carrier 62 receive, and make physical contact with, the inner conductor engager 80 and until the ground 60 engages, and makes physical contact with, the outer conductor engager 86. During operation, the non-conductive connector insulator 114 and the non-conductive driver 116 serve as electrical barriers between the inner conductor engager 80 and the one or more electrical ground paths surrounding the inner conductor engager 80. As a result, the likelihood of an electrical short is mitigated, reduced or eliminated. One electrical ground path extends: (i) from the outer conductor 106 to the clamp assembly 118, (ii) from the conductive clamp assembly 118 to the conductive connector body 112, and (iii) from the conductive connector body 112 to the conductive ground 60. An additional or alternative electrical grounding path extends: (i) from the outer conductor 106 to the clamp assembly 118, (ii) from the conductive clamp assembly 118 to the conductive connector body 112, (iii) from the conductive connector body 112 to the conductive coupler 128, and (iv) from the conductive coupler 128 to the conductive ground 60.

These one or more grounding paths provide an outlet for electrical current resulting from magnetic radiation in the vicinity of the cable connector 88. For example, electrical equipment operating near the connector 68 can have electrical current resulting in magnetic fields, and the magnetic fields could interfere with the data signals flowing through the inner conductor 84. The grounded outer conductor 106 shields the inner conductor 84 from such potentially interfering magnetic fields. Also, the electrical current flowing through the inner conductor 84 can produce a magnetic field that can interfere with the proper function of electrical equipment near the cable 88. The grounded outer conductor 106 also shields such equipment from such potentially interfering magnetic fields.

The internal components of the connector 68 are compressed and interlocked in fixed positions under relatively high force. These interlocked fixed positions reduce the likelihood of loose internal parts that can cause undesirable levels of passive intermodulation ("PIM") which, in turn, can impair the performance of electronic devices operating on the networks 2 and 12. PIM can occur when signals at two or more frequencies mix with each other in a non-linear manner to produce spurious signals. The spurious signals can interfere with, or otherwise disrupt, the proper operation of the electronic devices operating on the network 2. Also, PIM can cause interfering RF signals that can disrupt communication between the electronic devices operating on the network 2.

In one embodiment where the cables of the network 2 include fiber optic cables, such cables include fiber optic cable connectors. The fiber optic cable connectors operatively couple the optic tubes to each other. This enables the distribution of light-based signals between different cables and between different network devices.

Environmental Protection

Figure 7:
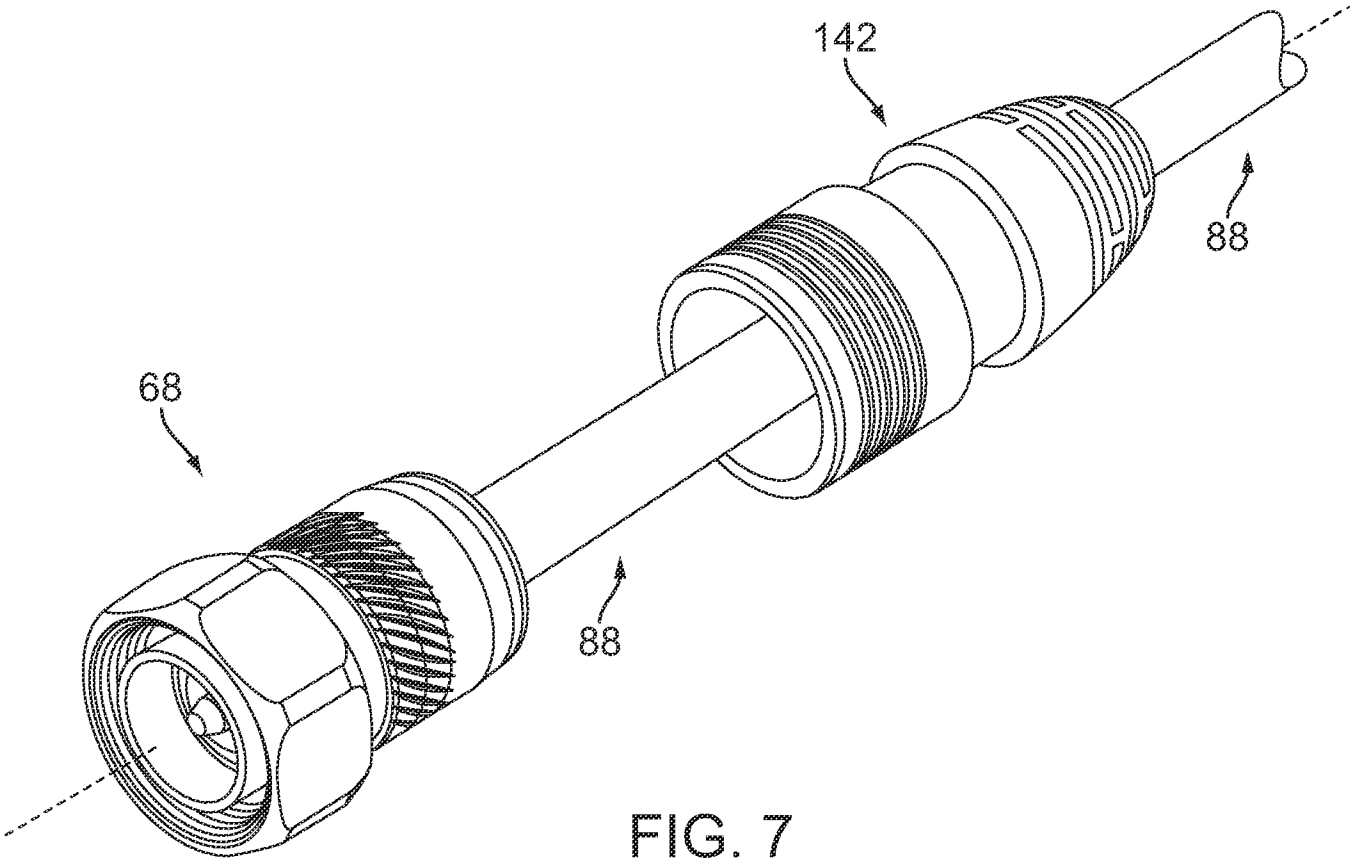
FIG. 7 is an isometric, exploded view of one embodiment of a cable assembly having a water resistant cover.
Figure 8:
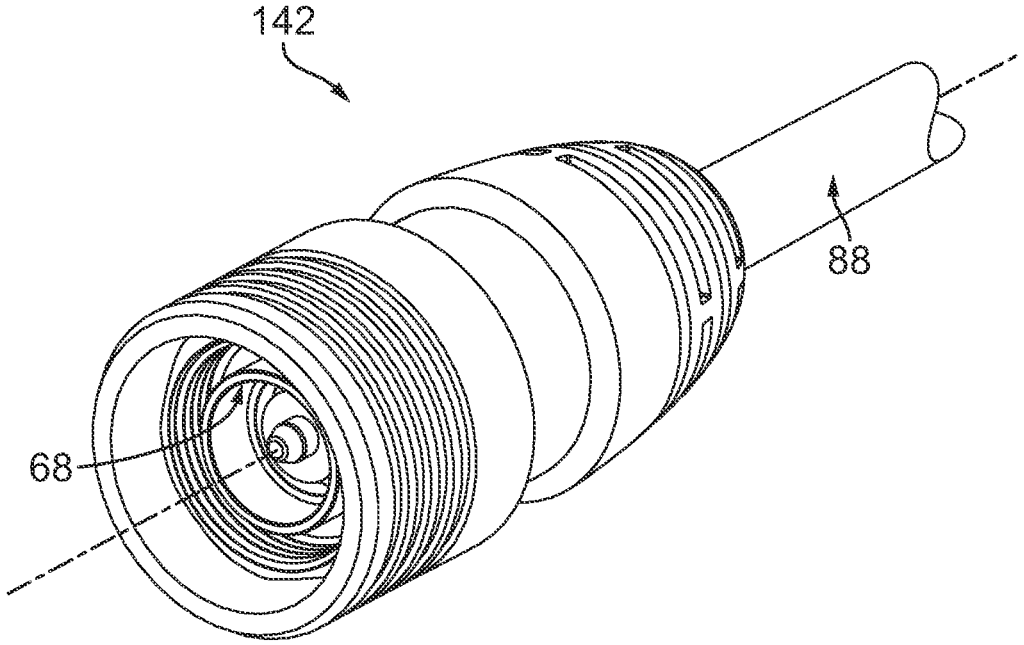
FIG. 8 is an isometric view of one embodiment of a cable connector covered by a water resistant cover.

In one embodiment, a protective boot or cover, such as the cover 142 illustrated in FIGS. 7-8, is configured to enclose part or all of the cable connector 88. In another embodiment, the cover 142 extends axially to cover the connector 68, the physical interface between the connector 68 and the interface port 52, and part or all of the interface port 52. The cover 142 provides an environmental seal to prevent the infiltration of environmental elements, such as rain, snow, ice, salt, dust, debris and air pressure, into the connector 68 and the interface port 52. Depending upon the embodiment, the cover 142 may have a suitable foldable, stretchable or flexible construction or characteristic. In one embodiment, the cover 142 may have a plurality of different inner diameters. Each diameter corresponds to a different diameter of the cable 88 or connector 68. As such, the inner surface of cover 142 conforms to, and physically engages, the outer surfaces of the cable 88 and the connector 68 to establish a tight environmental seal. The air-tight seal reduces cavities for the entry or accumulation of air, gas and environmental elements.

Hybrid Feed-Through Connector

FIGS. 9 through 13 depict exploded and sectional views of the various components which combine to connect a coaxial cable to an interface port. In this embodiment, a superflex coaxial cable 188 is prepared for coupling to a connector 200 which, in turn, connects to an interface port 300. The superflex coaxial cable 188 includes an inner conductor 190, an outer conductor 194, and insulating dielectric core 192 disposed therebetween. Furthermore, the outer conductor 194 is covered by a compliant or elastomer outer jacket 196.

Similar to the manner previously described, the coaxial cable 188 is stripped in a stepped fashion at predefined locations along the elongate axis 198 of the cable 188. The inner conductor 190 projects beyond a first step S1 formed by the outer conductor 194 and the insulating dielectric core 192. Additionally, a second step S2 is produced by the outer jacket 196 which is stripped back from the outer conductor 194.

While a superflex cable 188 is depicted, it should be appreciated that the invention is applicable to any conductive outer connector. In the described embodiment, the superflex cable 188 defines a corrugated, or spiral-shaped, outer conductor which facilitates deformation in an axial direction, i.e., in response to an axial force imposed along the elongate axis 198 of the coaxial cable 188. Specifically, the corrugations or spiral-shape outer conductor 194 facilitate accordion deformation thereof in response to the imposed axial force.

Figure 9:
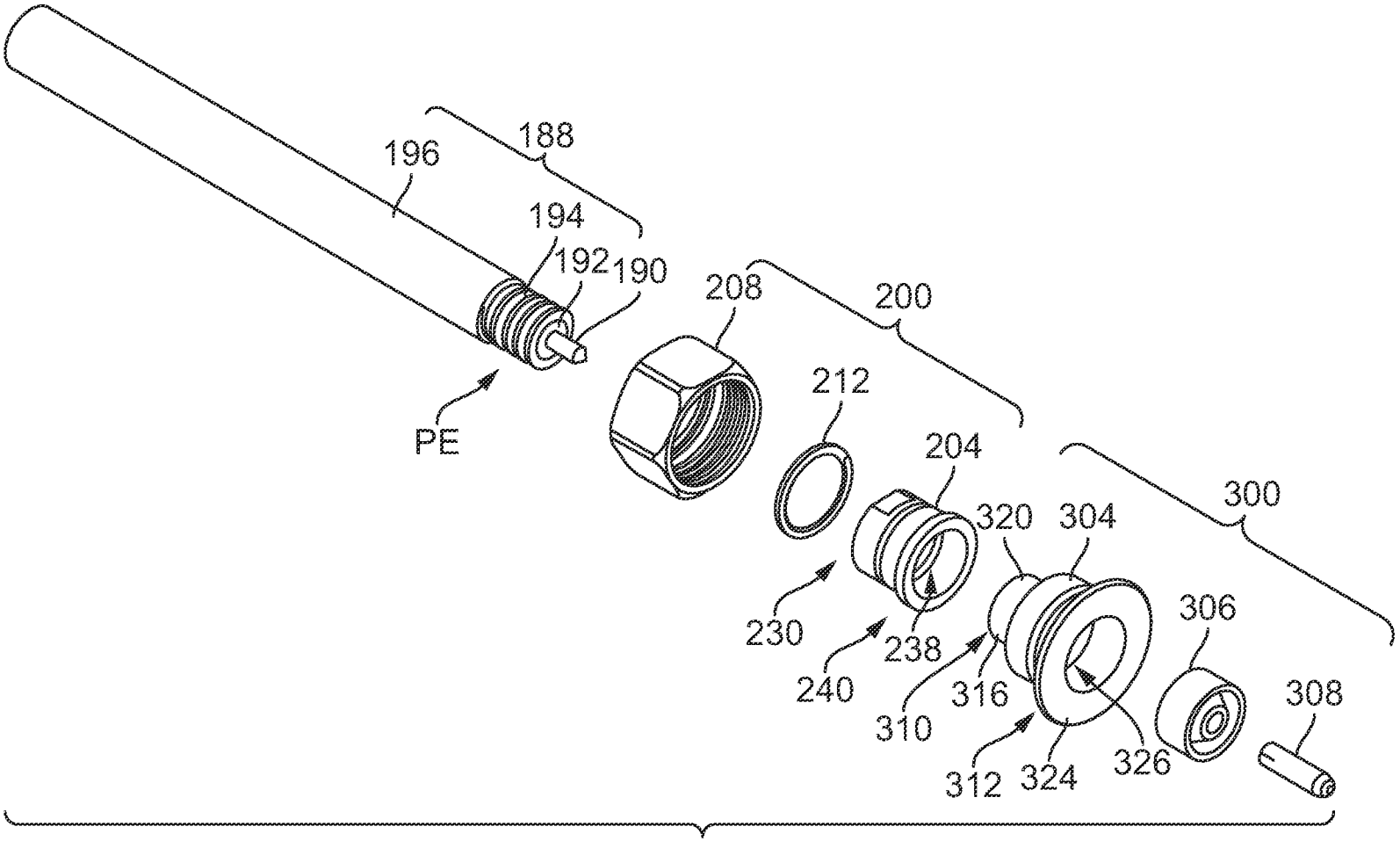
FIG. 9 is an exploded view of a hybrid feed-through connector for coaxial cables including a connector having a sleeve, a coupler and a retention member, the connector configured to cause an annular ring of a port body to compressively engage the outer conductor to biasingly maintain electrical contact with the interface port to ensure the maintenance of an electrical ground, even when the connector has become loose with respect to the interface port.
Figure 12:
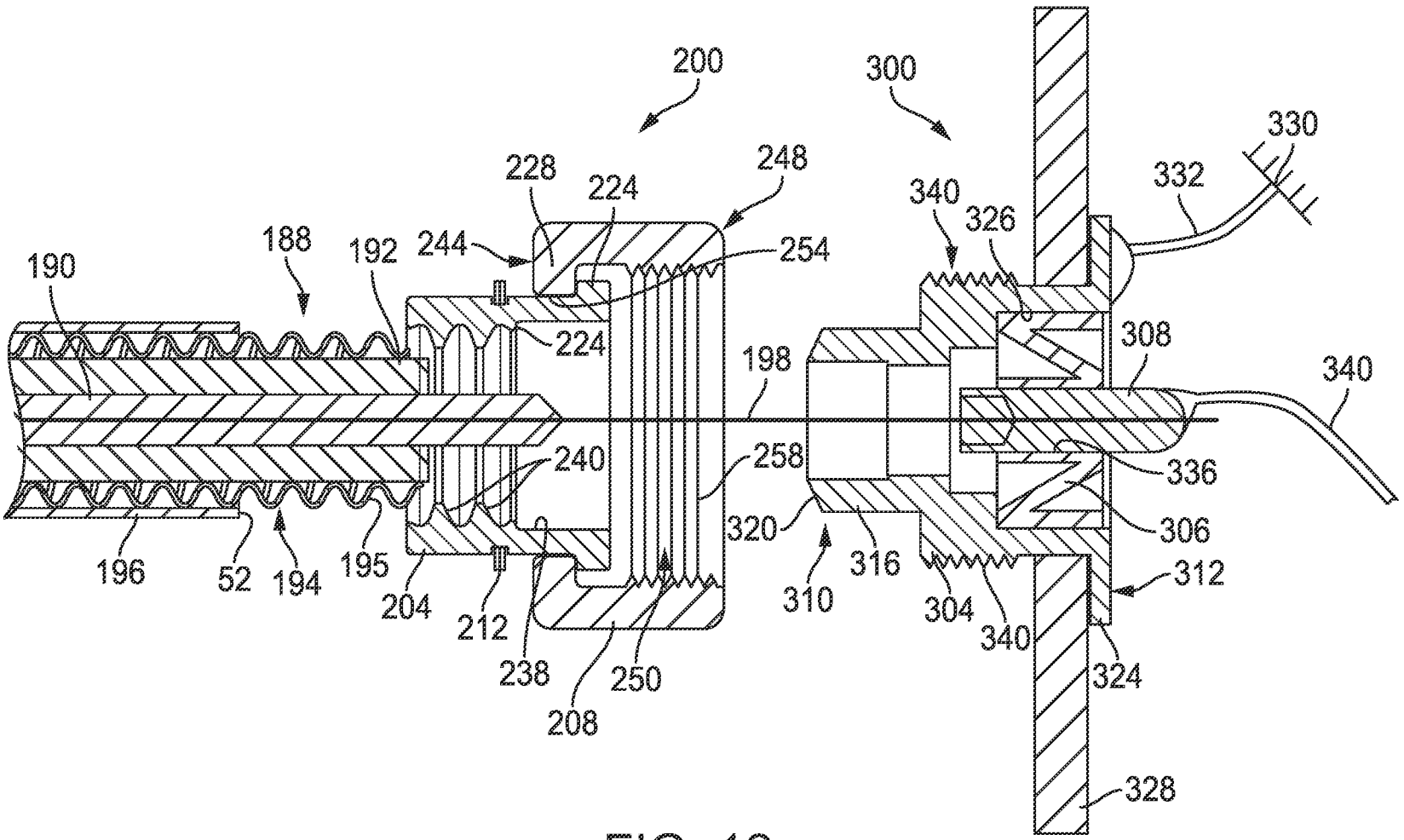
FIG. 12 depicts the coaxial cable, an interface port, and the connector of the present disclosure aligned for coupler with the coaxial cable to the interface port.

In FIGS. 9 and 12, the connector 200 couples the prepared superflex coaxial cable 188 to the interface port 300, and comprises: a conductive port body 304, an inner conductor engager 308 and a centering member 306 insulating the inner conductor engager 308 from the conductive port body 304. In the described embodiment, the centering member 306 has a Z-shaped cross-sectional shape to allow for a degree of transverse displacement, i.e., in a direction transverse to the elongate axis 198 of the coaxial cable 188. Furthermore, the port body 304 defines a first connector end 310 and a second grounding end 312. The first end 310 includes: (i) an annular ring 316 projecting rearwardly toward the coaxial cable 188, (ii) an annular compression surface 320 at the terminal end of the annular ring 316, and (iii) a central bore 322 extending from the first to the second ends 310, 312. The annular ring 316 projects axially forward toward the coaxial cable 188 while the annular compression surface 320 is shaped in the form of a conical frustum or, alternatively, a convex shape. As will be discussed in greater detail hereinafter, the shape of the annular surface 320 impacts the way the outer conductor 194 conforms to, or complements, the annular surface 320 and the efficacy of the electrical connection therebetween. Finally, the central bore 322 receives the insulating dielectric core 192 and the inner conductor 190 of the coaxial cable 188.

The second end 312 of the port body 304 defines an outwardly projecting flange 324 and a mounting cavity 326. The outwardly projecting flange 324 facilitates mounting to an RF device or to a conductive panel 328. In the described embodiment, electrical continuity between the port 300 and electrical ground 330 is established by an electrical lead 332 soldered to the flange 324. Alternatively, the conductive panel 328 may be connected to electrical ground such that the contact interface between the flange 324 and the conductive panel 328 provides an electrical path to ground. The port mounting cavity 326 supports the inner conductor engager 308 by supporting and centering the Z-shaped centering member 306. Specifically, the Z-shaped centering member 306 seats within a cylindrical bore of the cavity 326 which, in turn defines an aperture 336 disposed within the inner conductor engager 308 for mounting the inner conductor 190 of the coaxial cable 188. In the described embodiment, electrical continuity between the inner conductor engager 308 and the RF device (not shown) is established by an electrical lead 340 soldered to the inner conductor engager 308.

Finally, the port body 304 comprises an exterior mounting surface 340 disposed between the first and second ends 310, 312 which facilitates mounting to the connector 200. The mounting surface 340 may be threaded to threadably engage the connector 200 and axially draw the coaxial cable 188 toward the port body 304 in response to rotation of the connector 200. Alternatively, the mounting surface 340 may include any interlocking surfaces, e.g., spring tabs or cam surfaces, operative to effect axial displacement of the coaxial cable 188 in response to rotation of the connector 200 about the elongate axis 198.

Figure 10:
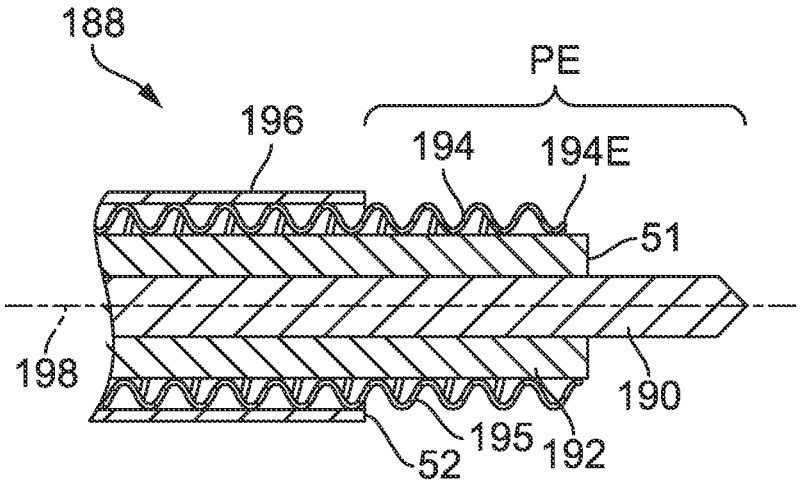
FIG. 10 is an enlarged view of a prepared end of a superflex coaxial cable.
Figure 11:
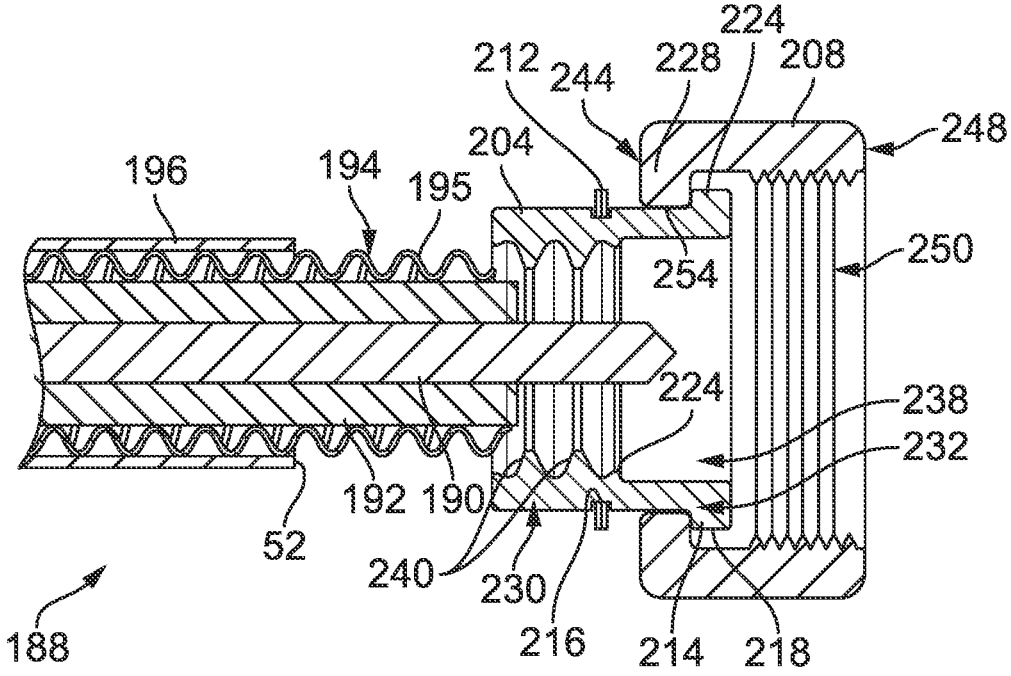
FIG. 11 depicts the coaxial cable in combination with the connector of the present disclosure.

In FIGS. 9, 10 and 11, the connector 200 is operative to mechanically and electrically couple the coaxial cable 188 to the interface port 300. Specifically, the connector 200 includes a sleeve 204, a coupler 208 and a retention member 212 operative to axially retain the coupler 208 to the sleeve 204. The sleeve 204 and coupler 208 are rotationally mounted along a mating interface defined by radially projecting inwardly and outwardly projecting shoulders 214, 218 associated with the sleeve 204 and coupler 208, respectively. In the described embodiment, the radial inwardly and outwardly projecting shoulders 214, 218 are formed by opposing inwardly and outwardly projecting flanges 224, 228 of the sleeve 204 and the coupler 208, respectively.

The sleeve 204 includes an aft end 230, a forward end 232, and a bore 238 extending between the aft and forward ends 230, 232. The bore 238 receives the prepared end PE of the coaxial cable 188 and is configured to engage an exterior surface 195 of the outer conductor 194 of a coaxial cable 188 such that a terminal end 194E of the outer conductor 194 extends beyond the abutment shoulder 236 by a threshold dimension D. More specifically, the sleeve 204 abuts the second step S2 defined by the stripped end of the outer jacket 196 and includes an inner surface 240, i.e., along the surface of the bore 238, having a contour which complements the corrugated spiral outer surface 195 of the outer conductor 194. As such, the complementary inner surface 240 couples the sleeve 204 to the outer conductor 194 such that rotational displacement of the sleeve 204 effects axial displacement of the outer conductor 194. That is, since the surface 195 of the outer conductor 194 has a spiral configuration, the surface 195 functions similarly to threads on a shaft wherein as the spiral inner surface 240 of the sleeve 204 engages the spiral surface 195 of the outer conductor 194, the rotational displacement of the inner surface 240 either effects: (i) axial displacement of the cable 188 or (ii) axial displacement of the sleeve 204 until the sleeve 204 abuts the second step S2 of the outer jacket 196.

The coupler 208 defines an aft end 244, a forward end 248 defining a coupler cavity 250, and a bore 254 extending between the aft end 244 and the coupler cavity 250. As described above, the aft end 244 of the coupler 208 is configured to rotationally and axially engage the forward end 232 of the sleeve 204 such that rotation of the coupler 208 effects relative axial displacement of the sleeve 204 and the coupler 208. While the described features include opposing flanges 224, 228 to facilitate rotation while enabling axial displacement, it will be appreciated that other structural configurations may be equally effective to perform this function. Accordingly, the disclosure is not limited to the embodiments illustrated herein.

In the described embodiment, a C-shaped retention ring 212 is disposed in an annular groove 216 to retain the coupler 208 relative to the sleeve 204 during normal use and handling. That is, the retention ring 212 allows the coupler 208 to be positioned in a first location or axial position relative to the port body 304, i.e., by backing the coupler 208 against the retention ring 212, and drawing the coaxial cable 188 toward the port body 304 to a second position, i.e., by threadably engaging the threads 340 of the port body 304.

In FIGS. 11 and 12, the coupler cavity 250 is configured to engage the interface port body 304 such that relative axial displacement of the sleeve 204 and the coupler 208 causes the annular surface 320 of the interface port body 304 to compressively engage the terminal end 194E of the outer conductor 194. More specifically, the coupler cavity 250 may include a plurality of female threads 258 for threadably engaging the exterior male threads 340 of the port body 304. As the coupler 208 rotates about the elongate axis 198, the opposing flanges 224, 228 draw the sleeve 204 toward the interface port body 304. Inasmuch as the complementary interior corrugated surface 240 of the sleeve 204 mechanically and frictionally engages the outer conductor surface 195 of the outer conductor 194, the coaxial cable 188 is also drawn toward the interface port body 304.

Figure 13:
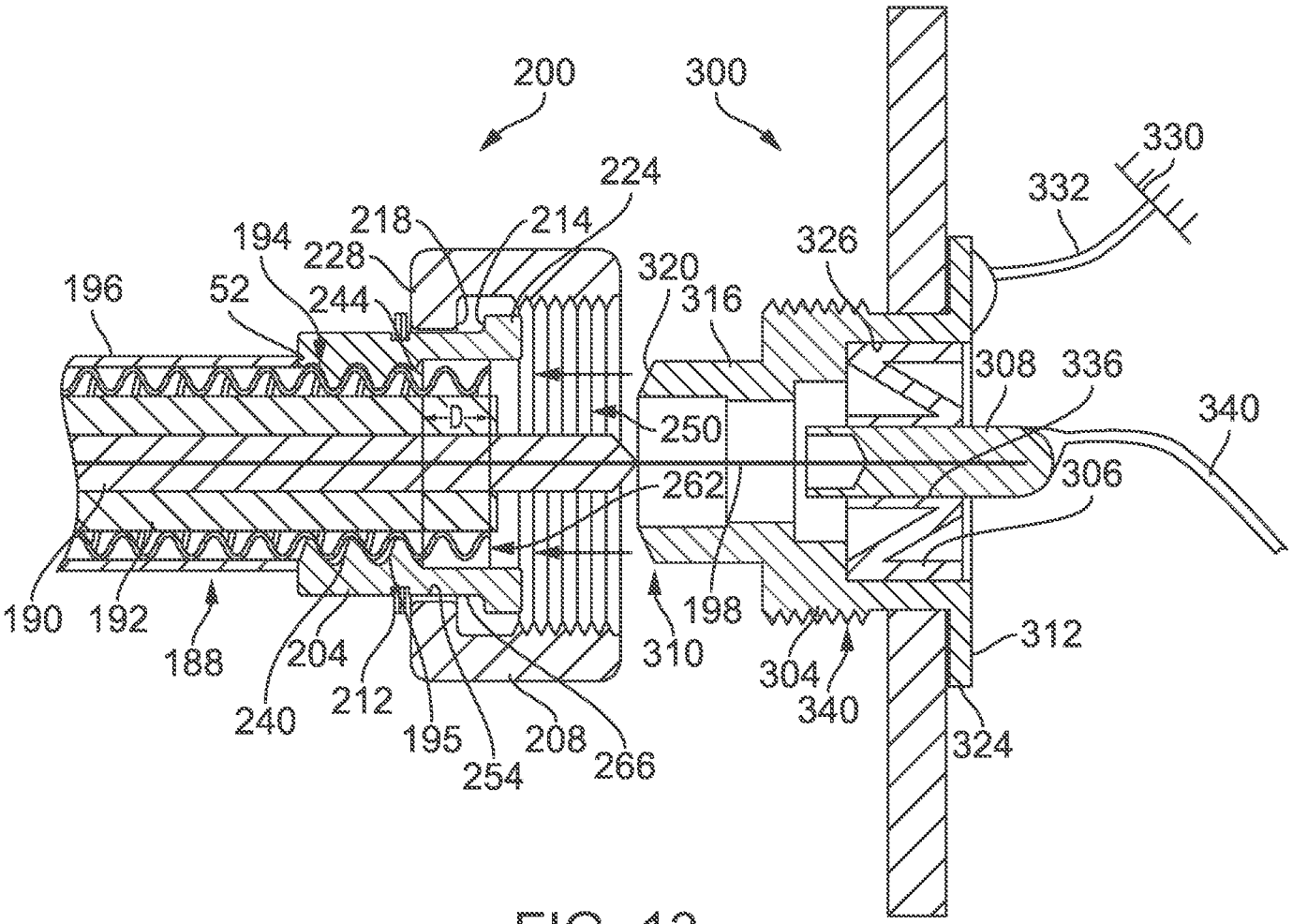
FIG. 13 depicts the connector of the present disclosure disposed in combination with the prepared end of the coaxial cable which have been prepared for connection to the coupler of the connector.
Figure 14:
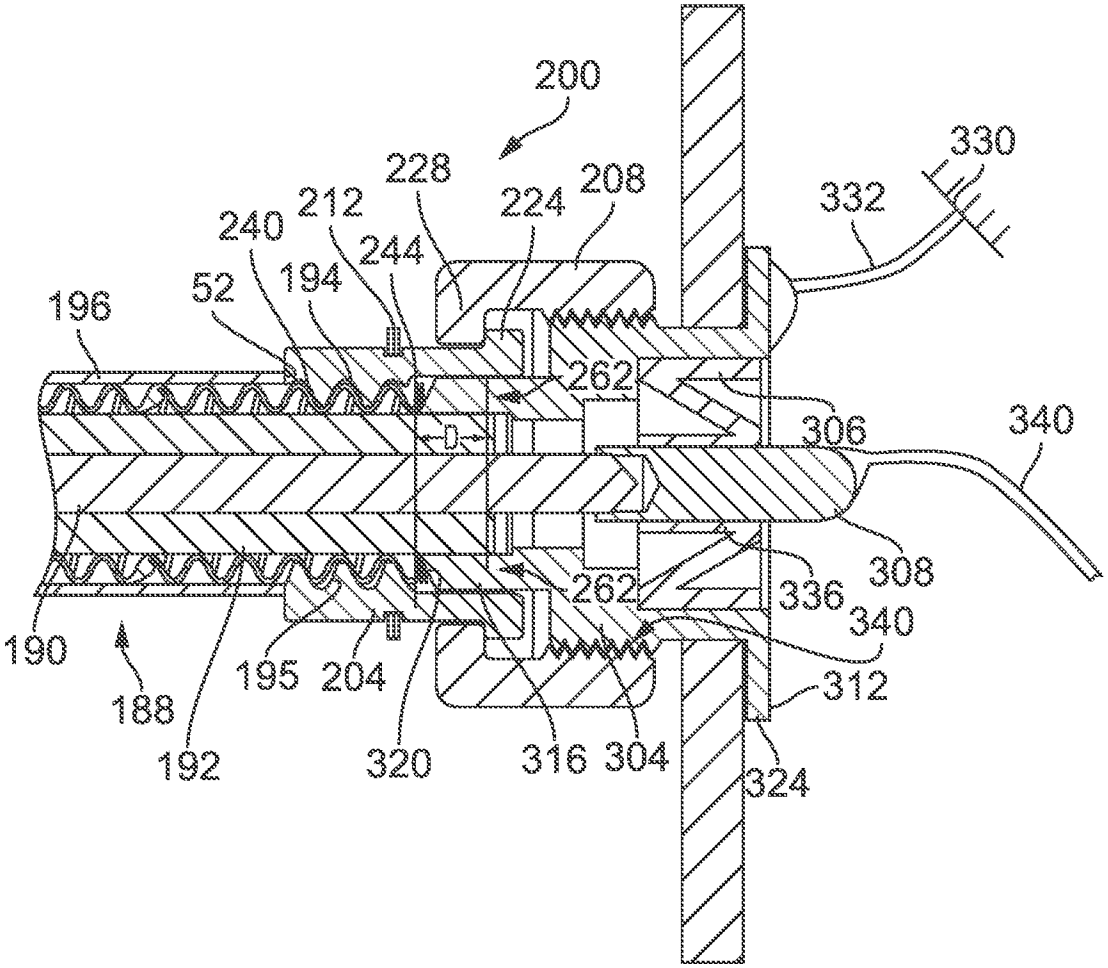
FIG. 14 depicts the connector of the present disclosure disposed in combination with both the prepared end of the coaxial cable and the interface port.

Referring to FIGS. 13 and 14, as the prepared end PE of the coaxial cable 188 is drawn toward the conductive port body 304, the annular ring 316 thereof is received within the annular cavity 262 formed between the bore 238 of the sleeve 204 and the dielectric core of the coaxial cable 188. As the threaded interface continues to draw the annular ring 316 into the annular cavity 262, the annular surface 320 of the annular ring 316 compressively engages the outer conductor 194 to axially deform the corrugations of the outer conductor 194. The relative displacement of the interface port body 304 and the coupler 208 cause the annular surface 320 to engage, and axially deform, the outer conductor 194. As a result, an electrical ground is effected from the outer conductor 194 to the port body 304 while, at the same time, securing a reliable connection between an RF signal-carrying inner conductor 190 and the inner conductor engager 308 of the interface port 300. In the described embodiment, the connector of annular surface 320 of the interface port body 304 defines a radial thickness dimension from a radially inboard edge of the annular surface to a radially outboard edge thereof. To ensure a reliable electrical ground, the outer conductor 194 defines a corrugation thickness, i.e., from a peak to a valley/trough, the radial thickness dimension is substantially equal to the corrugation thickness.

Once imposed, the compressive force develops a biasing feature which is maintained even after rotation of the coupler 208 is discontinued. That is, the accordion configuration of the outer conductor 194 continues to impose an axial bias such that should the coupler 208 loosen, the axial bias maintains electrical contact and a positive electrical ground between the outer conductor 194 and the interface port body 304. Consequently, the configuration defined herein has similar characteristics to connectors boasting constant biasing features wherein connectors maintain electrical continuity even when the connector has loosened.

Figure 15:
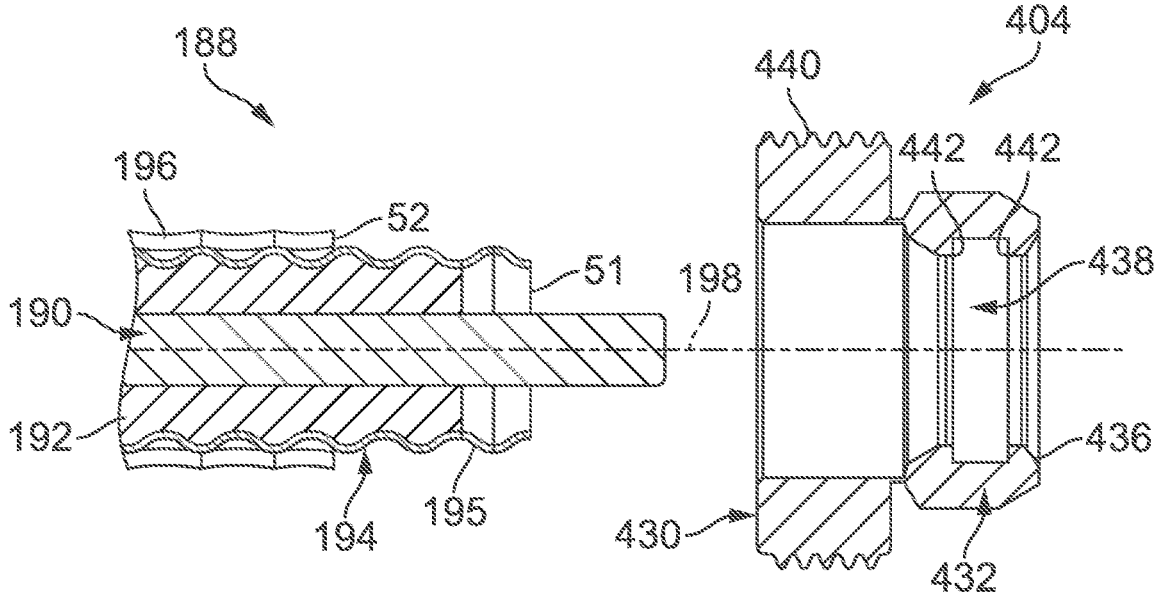
FIG. 15 depicts another embodiment of the present disclosure wherein a coupler threadably engages the sleeve to axially displace the coaxial cable toward an annular ring of the coupler and wherein the annular ring compressively engages the outer conductor to deform the outer conductor.
Figure 16:
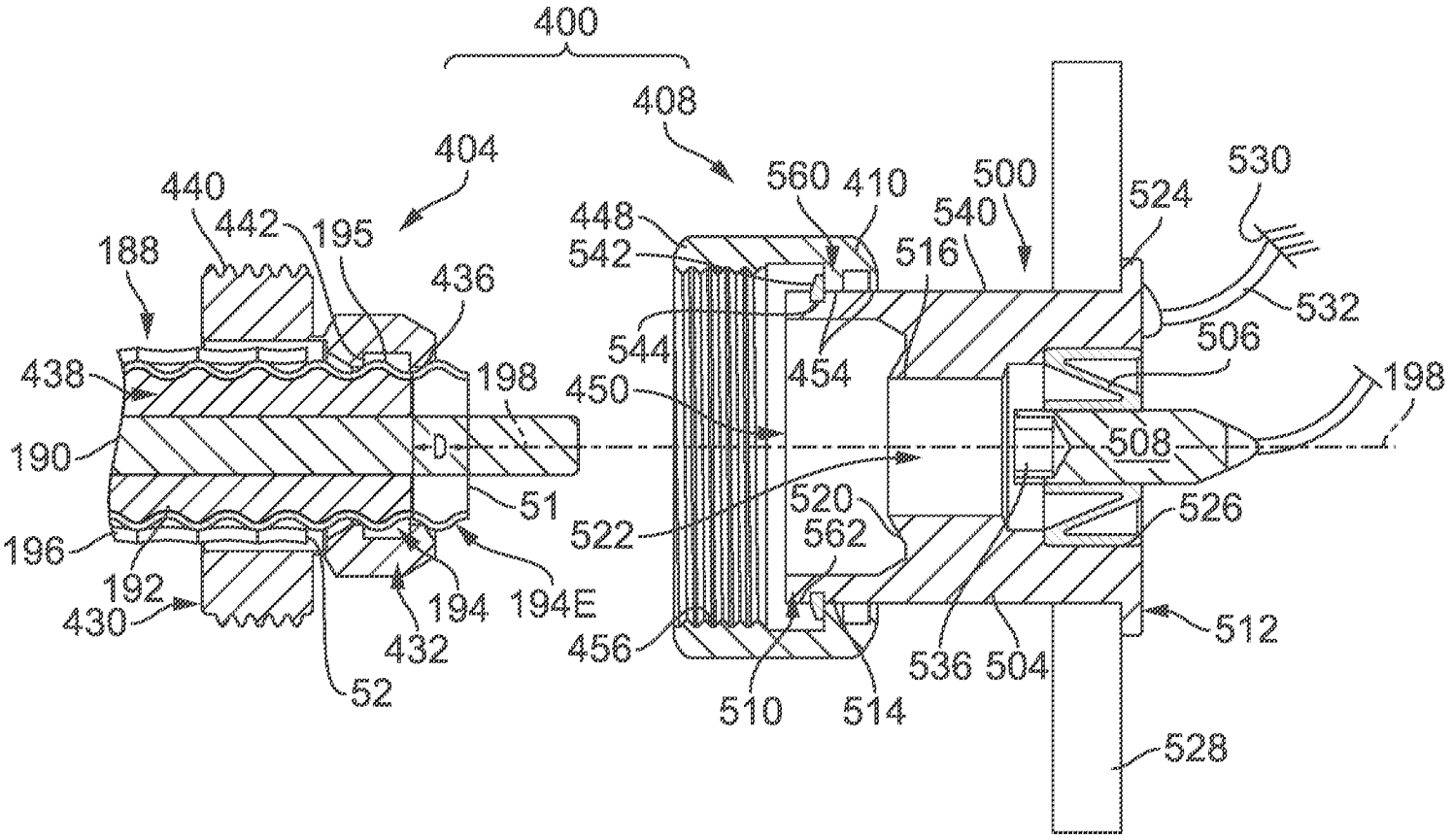
FIG. 16 depicts the prepared end of the cable disposed in opposed relation to an interface port having a port body mounted to a structural support.

In another embodiment depicted in FIGS. 15 and 16, the connector 400 includes a sleeve 404 disposed in combination with the prepared end PE of the coaxial cable 188 and a coupler 408 disposed in combination with a hybrid interface port 500. The prepared end PE of the coaxial cable 188 includes an inner conductor 190, an outer conductor 194, and insulating dielectric core 192 disposed therebetween. Furthermore, the outer conductor 194 is covered by a compliant or elastomer outer jacket 196. As described supra, the coaxial cable 188 is stripped in a stepped fashion at predefined locations along the elongate axis 198 of the cable 188 and the inner conductor 190 projects beyond a first step S1 formed by the outer conductor 194 and the insulating dielectric core 192. Additionally, a second step S2 is produced by the outer jacket 196 which is stripped back from the outer conductor 194.

The connector 400 couples the prepared coaxial cable 188 to the hybrid interface port 500 and comprises: a conductive port body 504, an inner conductor engager 508 and a Z-shaped centering member 506 insulating the inner conductor engager 508 from the conductive port body 504. In the described embodiment, the port body 504 defines a first connector end 510 and a second grounding end 512. The first connector end 510 includes: (i) an outer annular ring 514, (ii) and inner annular ring 516, (iii) an annular compression surface 520 at the terminal end of the annular ring 516, and (iii) a central bore 522 extending from the first to the second connector ends 510, 512. The outer and inner annular rings 514, 516 project axially forward toward the coaxial cable 188 while the annular compression surface 520 is shaped in the form of a conical frustum or, alternatively, defines an arcuate, or concave shape. As will be discussed in greater detail hereinafter, the shape of the annular surface 520 impacts the way the outer conductor 194 conforms to, or compliments, the annular compression surface 520 and the efficacy of the electrical connection made therebetween. Finally, the central bore 522 receives the insulating dielectric core 192 and the inner conductor 190 of the coaxial cable 188.

The second end 512 of the port body 504 defines an outwardly projecting flange 524 and an internal mounting cavity 526. The outwardly projecting flange 524 facilitates mounting to an RF device or to a conductive panel 528. In the described embodiment, electrical continuity between the port 500 and electrical ground 530 is established by an electrical lead 532 soldered to the flange 524. Alternatively, the conductive panel 528 may be connected to electrical ground 530 such that the contact interface between the flange 524 and the conductive panel 528 provides an electrical path to ground. The port mounting cavity 526 supports the inner conductor engager 508 by supporting and centering the Z-shaped centering member 506. Specifically, the Z-shaped centering member 506 seats within a cylindrical bore of the cavity 526 which, in turn defines an aperture 536 disposed within the inner conductor engager 508 for mounting the inner conductor 190 of the coaxial cable 188. In the described embodiment, electrical continuity between the inner conductor engager 508 and the RF device (not shown) is established by an electrical lead 540 soldered to the inner conductor engager 508.

Finally, the port body 504 comprises an exterior mounting surface 540 disposed between the first and connectors second ends 510, 512 which slidably mounts to an aft or inboard end 410 of the coupler 408. In this embodiment, the coupler 408 rotationally and telescopically mounts along the exterior mounting surface 540 and is retained by a conventional C-shaped retention ring 542 which is disposed within an annular groove 544.

In FIGS. 15-18, the connector 400 is operative to mechanically and electrically couple the coaxial cable 188 to the hybrid interface port 500. As described in preceding paragraphs and similar to the embodiment depicted in FIGS. 10-14, the connector 400 includes the sleeve 404, the coupler 408 and the retention member 542. In this embodiment, however, the retention member 542 is operative to axially retain the coupler 408 relative to the port body 504 rather than the sleeve 404. Accordingly, in one embodiment, the coupler 208 (shown in FIG. 12) is rotationally and slideably mounted to the sleeve 204 while, in another embodiment (shown in FIG. 16,) the coupler 408 is rotationally and slideably mounted to the port body 504.

The sleeve 404 includes an aft end 430, a forward end 432 defining an abutment shoulder 436, and a bore 438 extending between the aft and forward ends 430, 432. The bore 438 receives the prepared end PE of the coaxial cable 188 and is configured to engage an exterior surface 195 of the outer conductor 194 of a coaxial cable 188. Specifically, the exterior surface 195 of the outer conductor 194 extends beyond the abutment shoulder 436 such that a terminal end 194E of the outer conductor 194 extends beyond the abutment shoulder 236 by a threshold dimension D (FIG. 16).

More specifically, the sleeve 404 abuts the second step S2 defined by the stripped end of the outer jacket 196 and includes an inner surface 442, i.e., along the surface of the bore 438, having a contour which engages the corrugated spiral outer surface 195 of the outer conductor 194. As such, the inner surface 442 couples the sleeve 404 to the outer conductor 194 such that axial displacement of the sleeve 404 effects axial displacement of the outer conductor 194.

In the described embodiment, the sleeve and coupler 404, 408 define a coupler interface 440 (FIGS. 17 and 18) operative to axially draw the coaxial cable 188 toward the port body 504 in response to rotation of the coupler 408 about the elongate axis 198. The sleeve 404 may include a plurality of male threads 440 operative to engage the plurality of female threads 552 formed within the cavity 522 of the coupler 408. Alternatively, the coupler interface 440 may include any interlocking surfaces, e.g., spring tabs and cam surfaces, operative to effect axial displacement of the coaxial cable 188 in response to rotation of the coupler 408 about the elongate axis 198.

The coupler 408 defines an aft or inboard end 410, a forward or outboard end 448 defining an coupler cavity 450, and a bore 454 (FIG. 18) extending between the aft end 410 and the coupler cavity 450. As described above, the aft end 410 of the coupler 408 is configured to rotationally and axially engage the forward end of the port body 504. Specifically, rotation of the coupler 408 effects axial displacement of the sleeve 404 relative to the port body 504 while an inwardly projecting flange 560 engages the retention ring 542 to capture the coupler 408 on the port body 504. While a variety of configurations may be employed to facilitate rotation while retaining the axial position of the rotating element, it will be appreciated that other structural configurations may be equally effective at performing these functions. Accordingly, the disclosure is not limited to the embodiments illustrated herein.

Figure 17:
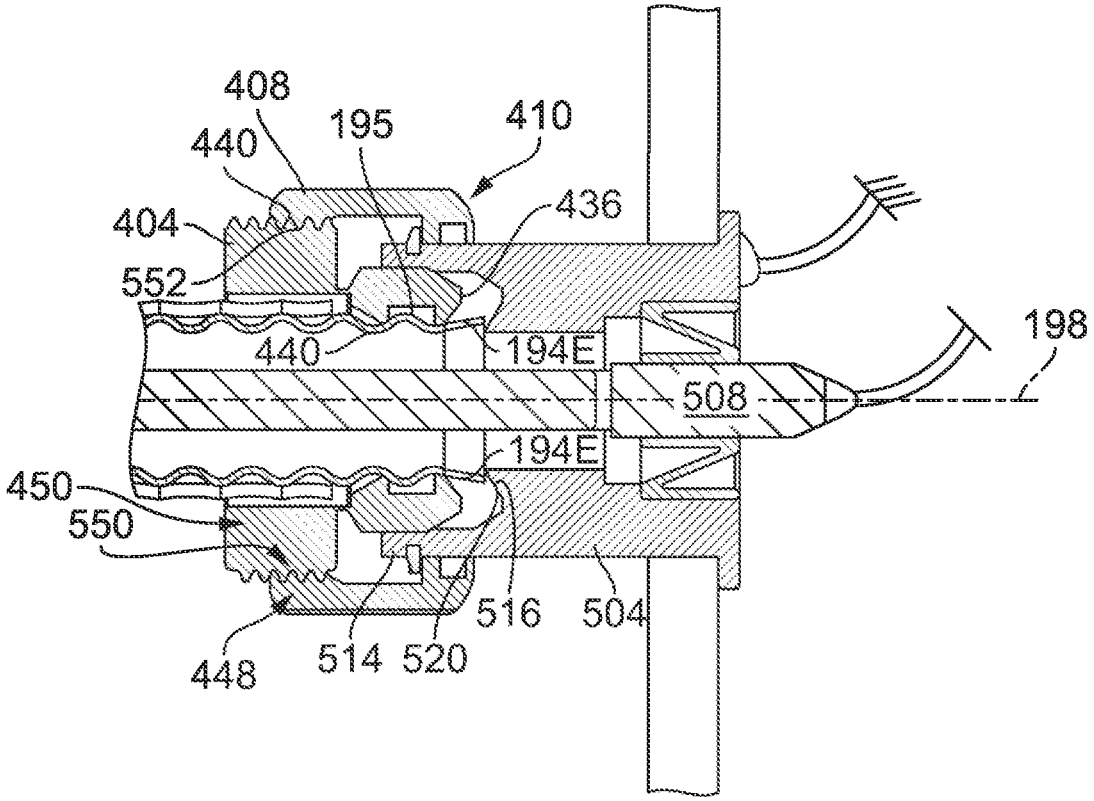
Figure 18:
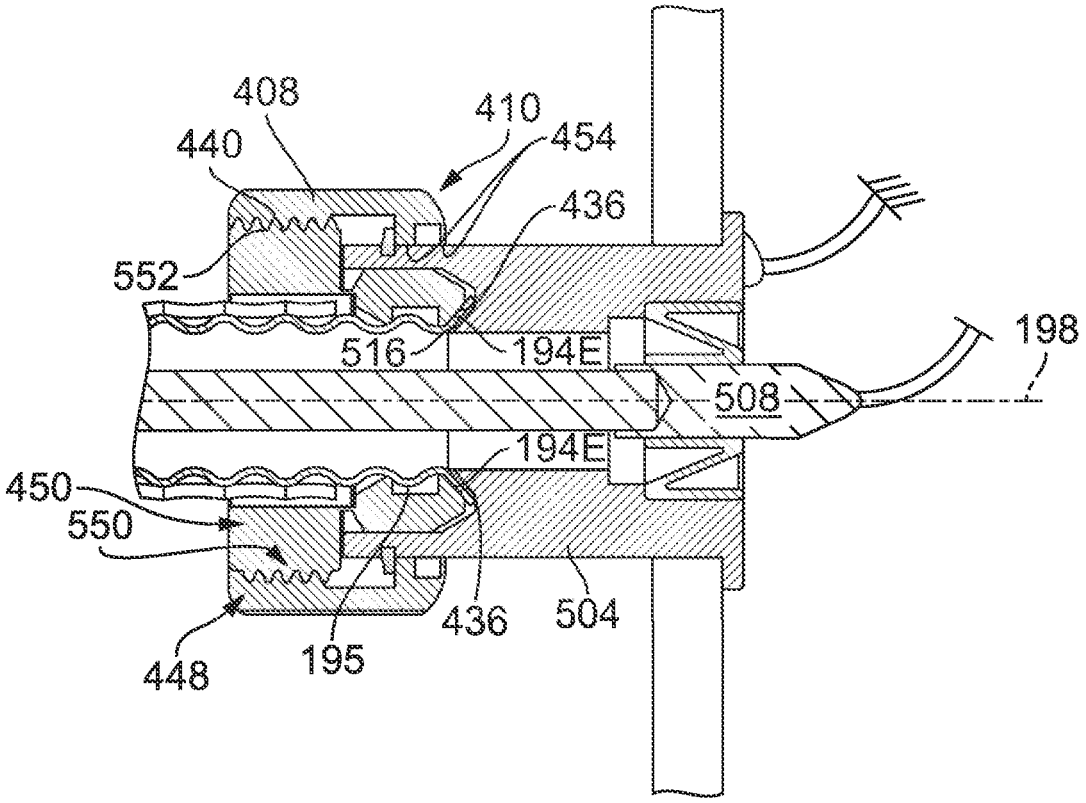

In FIGS. 17 and 18, the coupler 408 is configured to engage the interface port body 504 to effect axial displacement of the sleeve 404 relative to the interface port body 504. Operationally, the sleeve 404 receives the prepared end PE of the coaxial cable 188 through the bore 438 of the sleeve 404. The coaxial cable 188 extends through the bore 438 such that an end portion of the outer conductor 194 extends past the abutment shoulder 436 by a threshold dimension D. The inner or bore surface 438 engages the corrugations of the outer conductor 194 such that as the coupler interface 550 is drawn toward the sleeve 404, the annular surface 520 of the port body 504 compressively deforms the terminal end 194E of the outer conductor 194. That is, the inner annular ring 516 axially engages the terminal end 194E to produce a grounding path for electrical current. Once imposed, the compressive force develops a biasing force which is maintained even after rotation of the coupler 508 is discontinued. That is, the accordion configuration of the outer conductor 194 imposes an axial bias which continues such that should the coupler 508 loosen, the axial bias continues to maintain electrical contact, and a positive electrical ground between the outer conductor 194 and the interface port body 504.

Enhanced Electrical Grounding of Hybrid Electrical Connector

Further disclosed is a an RF connector, and grounding device therefor, that is configured for use in combination with a spiral flex outer conductor. The grounding device provides enhanced electrical contact with the outer surface of the spiral flex outer conductor when a port or cable connector compressively engages the end of the outer conductor. The present disclosure is described in the context of a cable jumper having a cable connector being axially compressed by a compressive clamping force induced by a compression cap. It should also be appreciated that the disclosure may also be described in the context of an interface port for compressively driving the spiral corrugations of the outer conductor together. In either case, a split ring washer is disposed in a trough between adjacent peaks and captured therebetween to electrically connect the outer conductor with the connector body.

In this disclosure, the grounding device includes a split helical washer for threadably engaging the helical outer conductor of the coaxial cable. The open, or free, end of the split helical washer engages the open end of the helical outer conductor. Rotation of the washer about the elongate axis of the coaxial cable causes the free end to be guided within the trough of the helical outer conductor. That is, the free end of the split helical washer is guided between a pair of ridges by an adjacent peaks or crests of the helical outer conductor.

Figure 19:
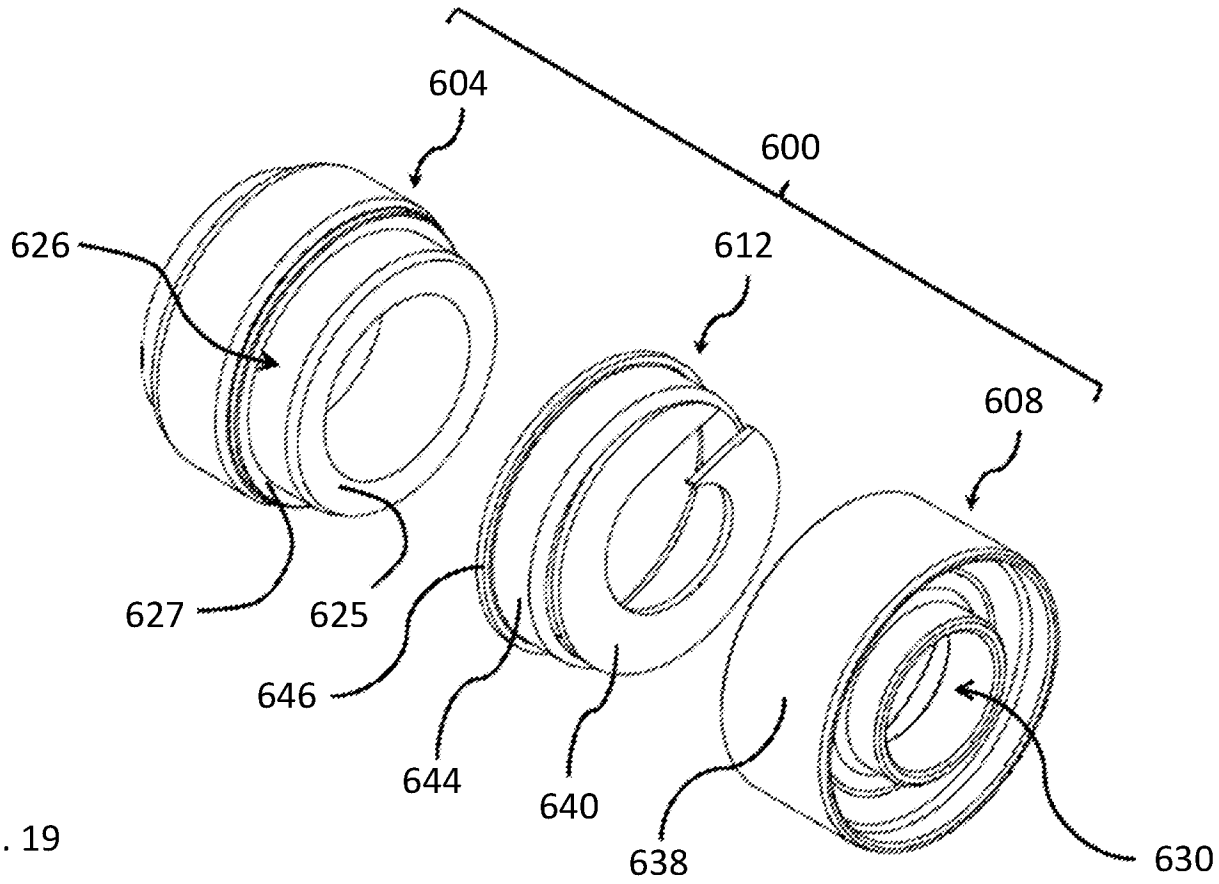
FIG. 19 depicts an exploded perspective view of three components according to yet another embodiment of the invention, which components collectively define a grounding device for a corrugated cable connector.
Figure 20:
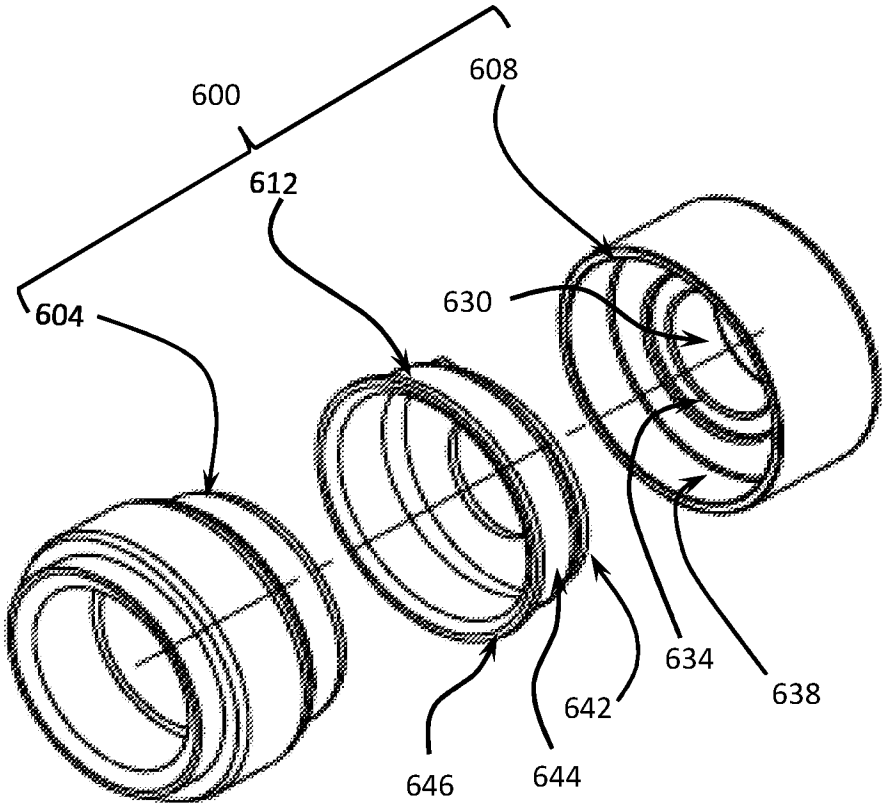
FIG. 20 depicts an exploded perspective view of the components depicted in FIG. 19 from an opposing direction.
Figure 21:
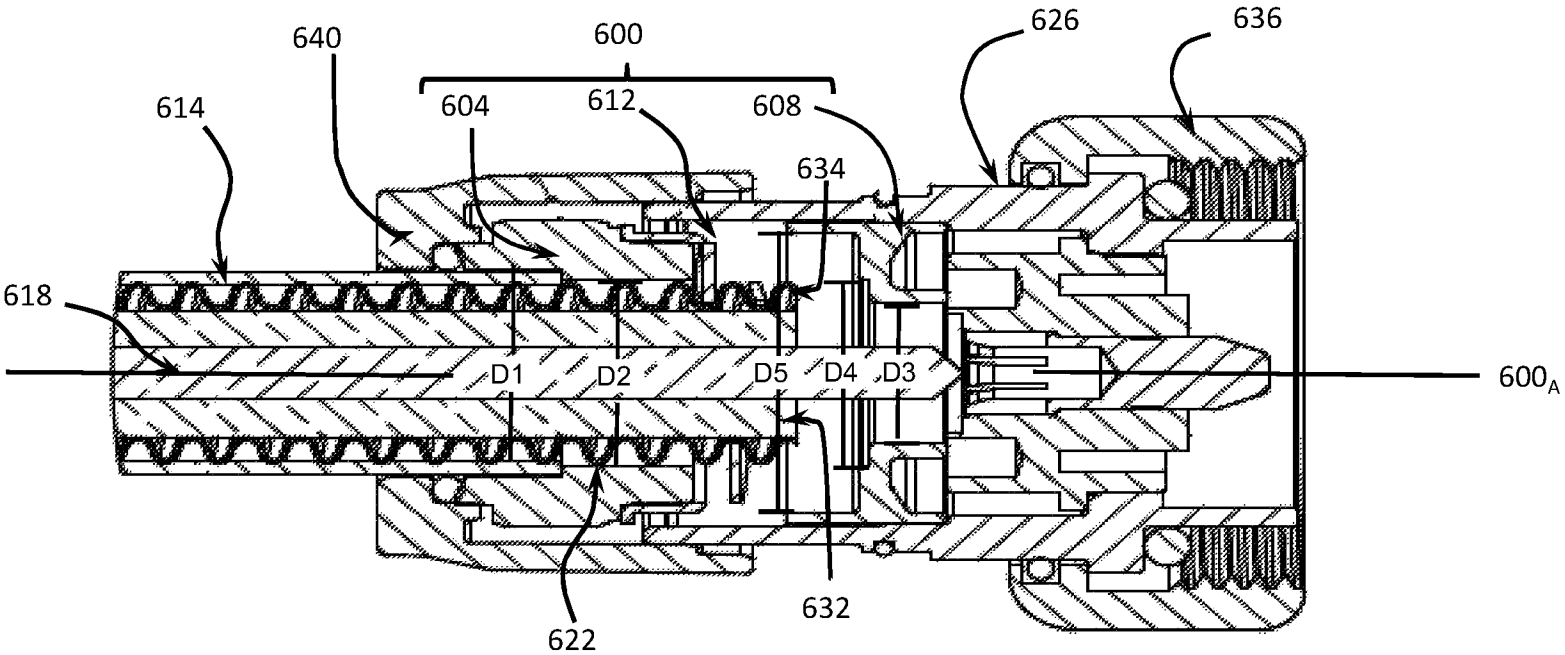
FIG. 21 depicts a cross-sectional view through the center of the grounding device including a driver, a contact ring and a spring clamp wherein the grounding device is in an open position in preparation for being axially compressed by rotation of a threaded coupler.
Figure 22:
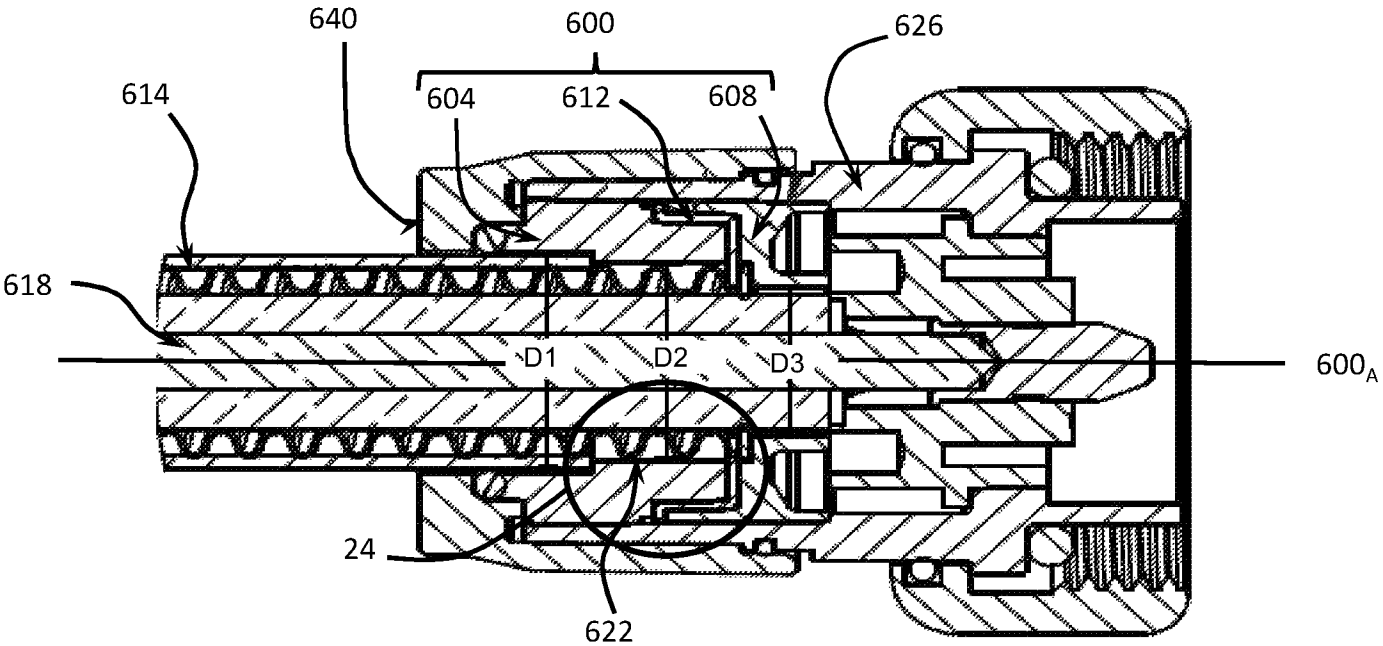
FIG. 22 depicts a cross-sectional view through the center of the grounding device in a closed position subsequent to compression by the coupler.
Figure 23:
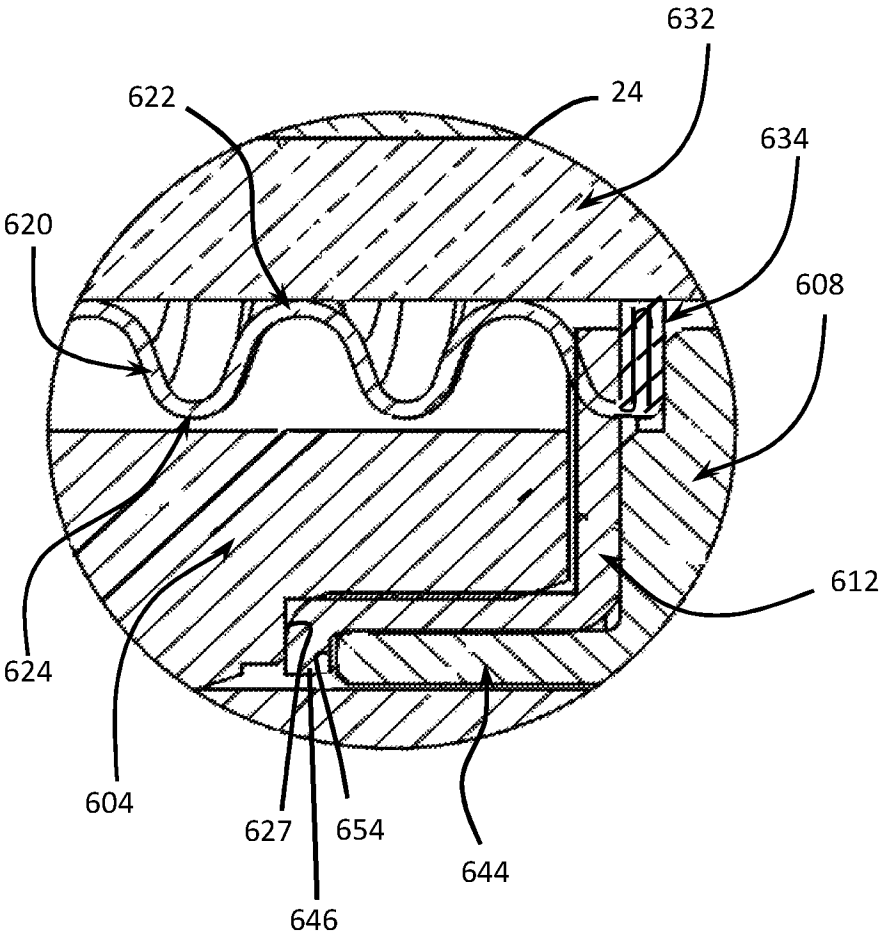
FIG. 23 is an enlarged view of the grounding device depicting the elements subsequent to compression by the coupler.

FIGS. 19-23 depict an inventive grounding device 600 according to the teachings of the disclosure comprising a driver 604, a contact ring 608 and a spring clamp 612 disposed therebetween. FIG. 19 and FIG. 21 depict the connector 600 in an open or uncompressed condition/position while FIG. 22 and FIG. 23 depict the connector 600 in a closed or compressed condition/position. The three elements 604, 608, 612 are compressively joined to effect engagement of the spring clamp 612 with the spiral coils 620 (FIG. 23) of the corrugated outer conductor. The peaks 622 of the spiral coils 620 face radially outward from the elongate axis 600A while the troughs 624 face radially inward therefrom.

The driver 604 of the grounding device 600 defines a first diameter dimension D1 (see FIG. 21) for receiving the compliant jacket 614 of the coaxial cable 618 and a second diameter dimension D2 for receiving the peaks 622 of the helical outer conductor 620. Additionally, the driver 604 defines an inwardly facing axial surface 625, an outwardly facing friction surface 626 and an inwardly facing abutment surface 627. Functionally, the driver 604 supports and retains the spring clamp 612 while centering and supporting the coaxial cable 618. The driver 604 also provides a degree of strain relief.

The contact ring 608 is disposed on the opposite side of the spring clamp 612 and abuts the connector body 626. The contact ring 608 defines an aperture 630 (FIGS. 20 & 21) for receiving a portion of the coaxial cable 618. More specifically, the aperture 630 of the contact ring 608 defines a third diameter dimension D3 for receiving the dielectric core 632 of the coaxial cable 618. Additionally, the contact ring 608 defines a fourth diameter dimension D4 which generates an annular surface 634 which opposes a forward end 636 of the helical outer conductor 620. Finally, the contact ring 608 defines a fifth diameter dimension D5 produced by an annular sleeve 638 which faces axially toward the friction end cap 640 of the connector 600. As will be seen when describing the compressed condition/position of the grounding device 600, the annular surface 634 functions to compressively capture a split spring washer 640 of the spring clamp 612 between the peaks 622 of the corrugated outer conductor 620.

The split spring washer 640 of the spring clamp 612 is integrated, i.e., welded in combination, with an annular ring 644 having a shouldered flange 646. The split spring washer 640 is disposed inwardly toward the body 626 of the connector 600 whereas the shouldered flange 646 is disposed outwardly toward the compression cap 640 of the connector 600. The split in the spring washer 640 allows for the washer 640 to be inserted from one side of the outer conductor 620 to the other side of the conductor 620. The pitch of the washer 640 is equal to the pitch of the spiral outer conductor so as to facilitate insertion of the washer 640 into to the region between the spiral coils.

Upon assembly, the driver 604 is disposed over the spiral coils of the helical outer conductor 620. Additionally, the spring clamp 612 engages the helical outer conductor 620 while, at the same time, engaging the region between the spiral coils as the split spring washer 640 is rotated about the elongate axis 600A of the connector 600. Next, the contact ring 608 is disposed within the body of the connector 600 such that the annular surface 634 of the contact ring 608 may oppose the forward end 636 of the helical outer conductor 620. Once the contact ring 608 is properly aligned, the compression cap 640 is drawn toward the body, causing the annular sleeve 638 to slide over the annular ring 644 of the spring clamp 612. As the compression cap 640 moves toward the connector body 626, an edge 654 of the annular sleeve 638 engages the shouldered flange 646 which, in turn, is driven against the inwardly facing abutment surface 627 of the driver 604. Furthermore, as the annular sleeve 638 slides over the annular ring 644 a friction fit is produced so as to wedge the three components, i.e., the driver 604, contact ring 608 and spring clamp 612, together.

As the three components 604, 608, and 612 are brought together, i.e., to prevent anyone of the components from backing away from the adjacent component, the peaks 622 of the spiral coil are axially compressed. In so doing, the split washer is trapped between, and secured by, the spiral coil of the helical outer conductor 620. The split washer of the spring clamp 612 is engaged along the entire length and width of the helical surface which makes for a very robust and complete electrical connection from one connector to another connector. While the disclosure describes a friction fit between the contact ring and the connector body to compressively couple the grounding device to the connector, it will be appreciated that the friction fit may be developed between other components such as between the contact ring and the spring clamp or between the contact ring and the driver of the grounding device.

The driver 604 may be fabricated from any one of a variety of materials including polyethylene, polyetheretherkeytone (PEEK). Materials having a high compressive strength, yield strength Young's Modulus may also be used.

The contact ring 608 may be fabricated from brass, copper, polyethylene, polyetheretherkeytone (PEEK). Other Materials with high compressive strength, stiffness, thermal stability, and high friction coefficients may be employed.

The spring clamp 612 may be fabricated from brass, copper, beryllium and other conductive materials having sufficiently high Young's Modulus and yield strength which does not interfere with the RF signal.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The invention claimed is:

1. An RF connector for electrically engaging a coaxial cable having a prepared end comprising corrugated outer and center pin conductors for exchanging RF signals, the RF connector comprising:

a connector body defining a bore for receiving the prepared end of the coaxial cable;

a coupler defining a bore for receiving a forward end of the connector body; and a compression cap defining a bore for receiving the prepared end of the coaxial cable and an aft end of the connector body; and a grounding device defining a driver, a contact ring and a spring clamp disposed therebetween, the driver having a bore for receiving the prepared end of the coaxial cable and engaging an aft end of the compression cap, the contact ring defining an aperture for receiving the prepared end of the coaxial cable and disposed between the coaxial cable and a conductive inner surface of the connector body, and the spring clamp defining a split ring washer configured to rotationally engage the corrugated surface of the outer conductor;

wherein upon delivering a compressive clamping force to the compression cap, spiral corrugations of the outer conductor compressively capture the split ring washer therebetween to electrically connect the outer conductor to the connector body.

2. The RF connector of claim 1 wherein a friction fit is produced between the contact ring and the connector body to compressively couple the grounding device to the connector.

3. The RF connector of claim 1 wherein a friction fit is produced between the contact ring and an annular ring of the spring clamp to compressively couple the grounding device to the connector.

4. The RF connector of claim 1 wherein a friction fit is produced between the contact ring and the driver to compressively couple the grounding device to the connector.

5. The RF connector of claim 1 wherein the spring clamp defines an annular ring having a shouldered flange and wherein the contact ring abuts the shouldered flange to compressively engage the split ring washer to produce a friction fit.

6. A grounding device for an RF connector to electrically ground a coaxial cable, comprising:

a driver having a central bore for receiving a prepared end of the coaxial cable;

a contact ring having an aperture for receiving the prepared end of the coaxial cable; and a spring clamp having split ring washer defining a bore for receiving the prepared end of the coaxial cable and interposing the driver and the contact ring, the spring clamp including an annular ring having a shouldered flange at one end and the split ring washer integrated with the other end; wherein upon delivering a compressive clamping force to a compression cap, the split ring washer is captured between adjacent peaks of an outer conductor of the RF connector, wherein the contact ring abuts the shouldered flange to compressively engage the split ring washer to produce a friction fit.

7. The grounding device of claim 6 wherein the contact ring is configured to produce a friction fit between a connector body and itself to compressively couple the grounding device to the connector.

8. The grounding device of claim 6 wherein the contact ring is configured to produce a friction fit between the spring clamp and itself to compressively couple the grounding device to the connector.

9. The grounding device of claim 6 wherein the contact ring is configured to produce a friction fit between the driver and itself to compressively couple the grounding device to the connector.

10. The grounding device of claim 6 wherein the driver of the grounding device defines a first diameter dimension for receiving a compliant jacket of the coaxial cable and a second diameter dimension for receiving the adjacent peaks of the outer conductor of the RF connector.

11. The grounding device of claim 10 wherein the aperture of the contact ring defines a third diameter dimension for receiving a dielectric core of the coaxial cable.

12. The grounding device of claim 11 wherein the contact ring defines a fourth diameter dimension which generates an annular surface opposing a forward end of the outer conductor of the RF connector.

13. The grounding device of claim 12 wherein the aperture of the contact ring defines a fifth diameter dimension produced by an annular sleeve which faces axially toward a friction end cap of the RF connector.

14. A method to facilitate electrical grounding of an RF connector, comprising the steps of:

configuring a grounding device to include:

a driver having a central bore for receiving a prepared end of the coaxial cable;

a contact ring having an aperture for receiving the prepared end of the coaxial cable;

a spring clamp defining an annular ring having a shouldered flange and a split ring washer defining a bore for receiving the prepared end of the coaxial cable and interposing the driver and the contact ring; and delivering a compressive clamping force to a compression cap such that the split ring washer is captured between adjacent peaks of an outer conductor of the RF connector thereby facilitating a uniform and constant ground between the outer conductor and split ring washer, wherein the contact ring abuts the shouldered flange to compressively engage the split ring washer to produce a friction fit.

15. The method according to claim 14 further comprising the steps of:

producing a friction fit connection between the contact ring and the spring clamp when clamping the compression cap to a connector body.

16. The method according to claim 14 further comprising the steps of:

producing a friction fit connection between the contact ring and a connector body when clamping the compression cap to the connector body.

17. The method of claim 14 further comprising the step of:

producing a friction fit connection between the driver and the contact ring when clamping the compression cap to a connector body.

18. The method of claim 14 further comprising the steps of:

receiving a compliant jacket of the coaxial cable through a first diameter dimension of the driver; and receiving the split ring washer between adjacent peaks of the outer conductor of the RF connector.

* * * * *